US009115535B2

(12) United States Patent
Blais

(10) Patent No.: US 9,115,535 B2
(45) Date of Patent: Aug. 25, 2015

(54) SLIDING SCREEN DOOR MECHANISM

(76) Inventor: Sam L Blais, Muskegon, MI (US)

( * ) Notice: Subject to any disclaimer, the term of this patent is extended or adjusted under 35 U.S.C. 154(b) by 314 days.

(21) Appl. No.: 12/857,085

(22) Filed: Aug. 16, 2010

(65) Prior Publication Data

US 2011/0162167 A1 Jul. 7, 2011

Related U.S. Application Data

(63) Continuation-in-part of application No. 12/118,069, filed on May 9, 2008, now abandoned, which is a continuation of application No. 11/860,917, filed on Sep. 25, 2007, now abandoned, which is a continuation of application No. 11/673,027, filed on Feb. 9, 2007, now abandoned.

(51) Int. Cl.

| | |
|---|---|
| ***E06B 9/52*** | (2006.01) |
| *E05D 15/06* | (2006.01) |
| *E06B 9/04* | (2006.01) |

(52) U.S. Cl.

CPC ..... *E06B 9/52* (2013.01); *E05D 15/0652* (2013.01); *E05D 15/0691* (2013.01); *E05Y 2900/136* (2013.01); *E05Y 2900/146* (2013.01); *E06B 9/04* (2013.01); *Y10T 16/364* (2015.01); *Y10T 16/379* (2015.01)

(58) Field of Classification Search

CPC ..... E05Y 2900/136; E05Y 2900/146; E06B 9/04

USPC ..... 160/89, 90, 96, 101, 105, 183, 215; 52/204.1, 204.5, 204.51, 204.71, 52/717.01; 49/409, 410, 411, 404, 501, 49/504, 63, 62, 61

See application file for complete search history.

(56) References Cited

U.S. PATENT DOCUMENTS

| | | | | |
|---|---|---|---|---|
| 4,048,774 | A * | 9/1977 | Yamamoto | 52/202 |
| 4,055,916 | A * | 11/1977 | Yamamoto et al. | 49/404 |
| 4,114,331 | A * | 9/1978 | Yamamoto | 52/202 |
| 4,270,322 | A * | 6/1981 | Ishida | 52/98 |
| 4,285,166 | A * | 8/1981 | Ishida | 49/63 |
| 4,819,295 | A * | 4/1989 | Kaftan | 16/72 |
| 5,551,501 | A * | 9/1996 | Davis et al. | 160/87 |
| 5,575,321 | A * | 11/1996 | Currier | 160/90 |
| 5,603,190 | A * | 2/1997 | Sanford | 52/202 |
| 5,937,928 | A * | 8/1999 | Chou | 160/168.1 V |
| 6,276,091 | B1 | 8/2001 | Ridgway | |
| 6,318,036 | B1 | 11/2001 | Siudzinski | |
| 6,371,188 | B1 | 4/2002 | Baczuk | |
| 6,497,265 | B2 * | 12/2002 | Davis et al. | 160/87 |
| 6,701,994 | B2 | 3/2004 | Goldenberg | |
| 6,789,601 | B2 * | 9/2004 | Rooth | 160/371 |
| 6,860,064 | B2 * | 3/2005 | Bakalar | 49/127 |
| 7,150,130 | B2 * | 12/2006 | Kobayashi et al. | 52/210 |
| 7,694,468 | B2 * | 4/2010 | Prince et al. | 52/204.55 |
| 2003/0201071 | A1 * | 10/2003 | Kobayashi et al. | 160/10 |
| 2004/0112552 | A1 * | 6/2004 | Rooth | 160/371 |
| 2006/0249262 | A1 * | 11/2006 | Tetu et al. | 160/98 |

* cited by examiner

*Primary Examiner* — Blair M Johnson

(74) *Attorney, Agent, or Firm* — Varnum, Riddering, Schmidt & Howlett LLP

(57) ABSTRACT

A sliding screen door mechanism (100) includes a bottom channel (122), top channel (124) and side channel (126). The bottom channel (122) has a web (132) and a bottom mount (134) which is screw fastened to a surface surrounding an entry door (112). The top channel (124) includes a top web (152), top door track (156) and top mount (154).

20 Claims, 14 Drawing Sheets

SLIDING SCREEN DOOR MECHANISM

CROSS-REFERENCE TO RELATED APPLICATIONS

This application is a continuation-in-part of U.S. patent application Ser. No. 12/118,069, filed May 9, 2008, which is a continuation of U.S. patent application Ser. No. 11/860,917, filed Sep. 25, 2007, which is a continuation of U.S. patent application Ser. No. 11/673,027, filed Feb. 9, 2007.

STATEMENT REGARDING FEDERALLY SPONSORED RESEARCH OR DEVELOPMENT

Not applicable.

REFERENCE TO SEQUENCE LISTING

Not applicable.

BACKGROUND OF THE INVENTION

1. Field of the Invention

The invention relates to screen door mechanisms generally and, more particularly, to sliding screen door mechanisms.

2. Background Art

The concept of employing various types of screen door mechanisms has been known for a substantial period of time. Such mechanisms are particularly advantageous in warm climates or otherwise during warm summers when it is advantageous to provide air ventilation between the exterior and interior of various types of structures, including commercial, industrial and residential.

Various types of screen doors have been utilized through recent history. For example, some types of screen doors utilize removable screens, and are configured so as to removably insert glass partitions or partitions made of other types of materials. This capability facilitates the adding of additional insulative structures (i.e., the "storm door" now transformed from the screen door) when the climate within which the screen door is being utilized becomes cooler. In addition to the capability of removing screens and inserting glass or similar types of partitions, some screen doors also provide "on-site" storage of the screens and the glass partitions simultaneously on the door itself. In this manner, when the user wishes to change from a screen door "feature" to a storm door "feature," the user merely needs to reposition the glass partition (and possibly the screen partition) within the door itself. Correspondingly, these various types of screen doors have been utilized with various types of structures for positioning, aligning and supporting the screen doors in proper positions. Many of the support structures are configured so as to be utilized with hinged screen doors, whereby the door is opened or closed through the exertion of external forces on the door sufficient so as to cause the door to rotate about the axis of its hinges. Such doors may also include other features, such as equipment for providing for automatic door closure and the like.

In addition to conventional types of screen doors which rotate about their hinges, other types of screen doors are commonly known as "sliding" screen doors. Sliding screen doors are well known and are often used when space around the screen door does not lend itself to situations where the screen door must be rotated outside of its conventional plane (e.g., the plane of the door surface when the door is closed) for purposes of being opened. Also, sliding screen doors are much more advantageous when the screen partitions are of a relatively large surface area. For example, in residential structures, doors to outside patios are often relatively large. Using rotating screen doors may be substantially impractical in these types of situations. Accordingly, "sliding" screen doors are often utilized, whereby the screen partition surface remains in a single plane when the door is opened and closed. Again, such sliding screen doors are relatively well known in the industry.

For sliding screen doors, the supporting structures for supporting the screen door while correspondingly permitting a sliding movement for the door are also relatively well known. Many times, door structures such as those associated with supporting and positioning patio doors include structures for also supporting and positioning screen doors, and the sliding movement thereof. However, in many instances after a residence or industrial structure has been built, it may be found that it would be advantageous to utilize sliding screen doors adjacent regular doors where mechanisms for supporting the screen doors were not initially installed within the residence or industrial establishment. In particular, it has been found that doorways between interiors of houses and attached garages often do not include any type of mechanism to facilitate usage of a screen door. However, when screen door support mechanisms have not been initially incorporated within residential or industrial structures, it has been difficult to add such support mechanisms to the existing doorway structures. Known systems may require removal or modification of pieces of existing doorways or other activities which may be complex, laborious and/or expensive. Accordingly, it would be advantageous to provide for a sliding screen door support mechanism which is relatively easy to install, relatively inexpensive, and adaptable to situations involving both new installation and what may be called "retrofitting" of sliding screen doors to existing structures.

BRIEF SUMMARY OF THE INVENTION

In accordance with the invention, a sliding screen door frame is adapted to be utilized with a sliding screen door. The frame is further adapted to at least partially circumscribe an entry door. The sliding screen door frame includes a bottom channel having an elongated configuration. The bottom channel includes bottom channel connecting means for mounting the bottom channel to a stationary and vertical surface surrounding the entry door. A bottom channel track means is also included as part of the bottom channel, and is adapted to cooperate with the sliding door in a sliding arrangement, so as to provide a stabilized path on which the screen door may move between open and closed positions. In addition to the foregoing, the bottom channel also includes bottom channel web means connecting together the bottom channel connecting means and the bottom channel track means.

Still further, the sliding screen door frame includes a top channel having an elongated configuration. The top channel includes top channel connecting means for mounting the top channel to a vertical surface surrounding or otherwise associated with the entry door. Top channel track means are provided for receiving the top portion of the screen door in a sliding engagement. In this manner, a path is provided for movement of the screen door between open and closed positions. Still further, the top channel includes top channel web means connecting the top channel connecting means and the top channel track means. In accordance with another aspect of the invention, the sliding screen door frame may include a side channel extending vertically along at least a portion of a path extending between a first end of the top channel and a first end of the bottom channel. The side channel provides for a strike or a stop for the screen door, when the screen door is in a closed position.

The bottom channel web means can include a horizontally disposed and elongated bottom web having first and second opposing edges extending longitudinally along the elongated configuration of the bottom web. The bottom channel connecting means can include a vertically disposed flange connected to or integral with the first one of the opposing edges of the bottom channel web means. Still further, the bottom channel track means can include a vertically disposed and elongated flange connected to or otherwise integral with the second edge of the bottom channel web means. The flange can have an upper edge operating as a bottom track for the screen door, so as to provide the stabilized path. Correspondingly, the vertically disposed flange of the bottom channel connecting means can include a bottom mount having spaced apart apertures extending horizontally therethrough. The spaced apart apertures are adapted to receive attachment means for attaching the bottom mount to the stationary and vertical surface surrounding the entry door.

The horizontally disposed and elongated bottom web can have a width between the first opposing edge and the second opposing edge which causes the bottom door track to be centered approximately 1.625 inches away from the stationary and vertical surface surrounding the entry door. Correspondingly, the bottom door track can extend upwardly approximately 1.0 inches above the horizontally disposed and elongated bottom web. Still further, the bottom channel mount can extend approximately 1.0 inches down from or below the horizontally disposed and elongated bottom web. Still further, the length of the bottom channel track can be at least twice the width of the screen door to be used with the sliding screen door frame.

In accordance with other concepts of the invention, the top channel web means can include a horizontally disposed and elongated top web having a first opposing edge and a second opposing edge extending longitudinally along the elongated configuration of the top web. The top channel connecting means includes a vertically disposed flange connected to or integral with the first opposing edge of the top web. Further, the top channel track means can include a pair of vertically disposed and elongated flanges connected to or otherwise integral with the top web and extending downwardly from the top web at or adjacent to the second opposing edge of the top web.

In accordance with other concepts of the invention, the pair of vertically disposed and elongated flanges of the top channel track means form a downwardly opening U-shaped channel portion. The U-shaped channel portion is adapted to receive the top portion of the screen door in the sliding engagement. In this manner, the channel portion provides the path for movement of the screen door between the open and closed positions. The depth of the U-shaped channel of the top door track is sufficient so as to accommodate over insertion of the screen door into the U-shaped channel of the top door track, for purposes of installation.

Still further, the top channel track means can include a top channel door rail extending downwardly from a bottom surface of the top channel web. The top channel door rail can have a vertically disposed and elongated configuration, with the top door rail being substantially centered between the pair of flanges forming the U-shaped channel portion. In this manner, when the screen door is installed on the sliding screen door frame, the top portion of the screen door is in a sliding engagement with the top door rail. A path is thus provided for movement of the screen door between the open and closed positions.

In accordance with still further concepts of the invention, the vertically disposed flange of the top channel connecting means extends upwardly from the first edge of the top web. The vertically disposed flange includes a top mount having spaced apart apertures extending horizontally therethrough. The spaced apart apertures are adapted to receive attachment means for attaching the top mount to the stationary and vertical surface surrounding the entry door.

Still further, the horizontal and elongated top web has a width between the first opposing edge and the second opposing edge which causes the top door track to be centered approximately 1.625 inches away from the stationary and vertical surface surrounding the entry door. The pair of flanges of the top door track can be spaced apart approximately 0.625 inches. Correspondingly, the pair of flanges of the top door track can also extend downwardly from the top web a distance of approximately 2.0 inches. Still further, the top channel mount can extend approximately 1.0 inches upwardly from the first opposing edge of the horizontally disposed and elongated top web. Still further, a length of the top channel track can be at least twice the width of the screen door to be used with the sliding screen door frame.

In addition to the foregoing, the pair of flanges of the top door track can be characterized as including an inner flange and an outer flange. In accordance with one concept of the invention, the outer flange of the top channel can be extended downwardly below the lower most portion of the inner channel, so as to cover an upper gap which may be associated with the screen door.

The side channel can include an elongated and vertically disposed side web having first and second opposing edges. A side flange includes a vertically disposed and elongated configuration, extending along at least a portion of the first edge of the side web. The flange of the side channel provides for a strike or a stop for a first end of the sliding screen door, when the sliding screen door is in a closed position. Further, the side web of the side channel can include spaced apart apertures adapted to receive attachment means for attaching the side channel to the stationary and vertical surface surrounding the entry door. Still further, the side web of the side channel can have a width in the range of approximately 1.0 inches to 1.5 inches.

In accordance with other concepts of the invention, the sliding screen door frame can include stop means mounted to respective first ends of the bottom channel and the top channel, so as to provide for a strike or stop for the sliding screen door when the screen door is in a fully opened position. Still further, the top channel can be formed as a box-like configuration comprising a channel box. A bottom of the channel box forms the top channel web means, and one side of the channel box forms the top channel connecting means. In accordance with a still further concept of the invention, the bottom channel can include a box-like configuration having a channel box, with a bottom of the channel box forming the bottom channel web means. Further, one side of the channel box can form the bottom channel connecting means.

In addition, the screen door can include one or more rollers extending upwardly from or adjacent the top of the screen door, and positioned so as to rotatably ride on the top door rail when the screen door is installed on the screen door frame. Also, the screen door can include a self-closing device to move the screen door to a fully closed position following application of external forces on the door which cause the door to move to a fully or partially open position.

BRIEF DESCRIPTION OF THE SEVERAL VIEWS OF THE DRAWING

The invention will now be described with respect to the drawings, in which.

DETAILED DESCRIPTION

The principles of the invention are disclosed, by way of example, in a number of embodiments of sliding screen door mechanisms as illustrated in FIGS. 1-28, and discussed below. Various embodiments of sliding screen door mechanisms in accordance with the invention provide various advantages. In certain embodiments, the screen door associated with the sliding screen door mechanism is configured so as to only be used when needed. That is, the screen door is self-storing. Further, with certain of the screen door mechanisms in accordance with the invention, the screen door can be made to slide to the left or the right, without any significant modifications or reconfigurations in the mechanism. From the design of the embodiments of the screen door mechanisms in accordance with the invention, it will also be made apparent that the mechanisms in accordance with the invention are relatively more convenient and safer than known mechanisms. In particular, with respect to the elements of the screen door frames associated with the invention, handicap accessibility is facilitated. Further, it is estimated by the inventor that the screen door mechanisms in accordance with the invention as described herein can be made to fit approximately 96 percent of existing homes. In this regard, the various channels of the screen door frames discussed herein can readily be retrofitted with most brick moldings found in existing homes. Accordingly, such retrofit applications have little need for any alterations in the existing door structures of the homes.

Still further, and as will be made apparent from subsequent description herein, bottom channels associated with the screen door mechanisms can readily be adjusted so as to provide for a relatively smooth glide or slide, even when associated brick molding is not square or is otherwise out of plumb. The bottom channel can be mounted through fairly simplistic processes under the threshold. Because of the simplicity and general structure of the bottom channels, they are basically indestructible and should last for the lifetime of the associated home.

Still further, side channels which may be utilized in accordance with the invention, can be installed with a relatively minimum number of screws or other connection means. In addition, the side channels readily retrofit with standard brick molding of existing home construction. Still further, screen doors utilized with the sliding screen door mechanisms in accordance with the invention can readily be made to glide into the side channels so as to provide for a snug fit, thereby stopping insects from entering the home. Also, the design of the side channels in accordance with the invention permit the use of bug guards on the opposite side of the screen door. In addition, all of the channels described herein can be constructed of durable extruded aluminum, with a high gloss powder coating, and having pre-drilled holes.

Figure 1:
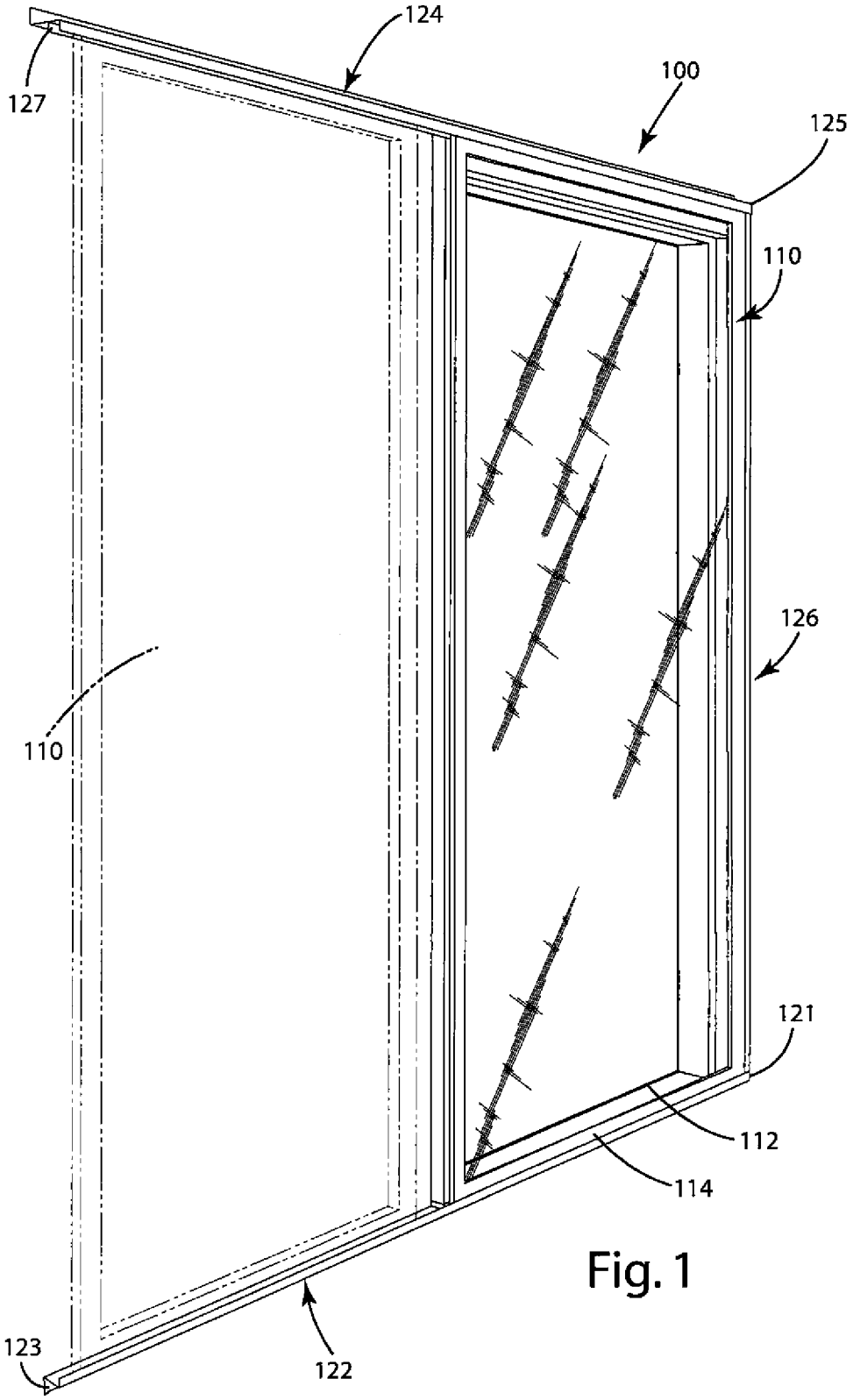
FIG. 1 is a left side perspective view of a sliding screen door mechanism in accordance with the invention, with the screen door being shown in a solid line format in a closed position, and with the sliding screen door being shown in a phantom line format in an open position.
Figure 2:
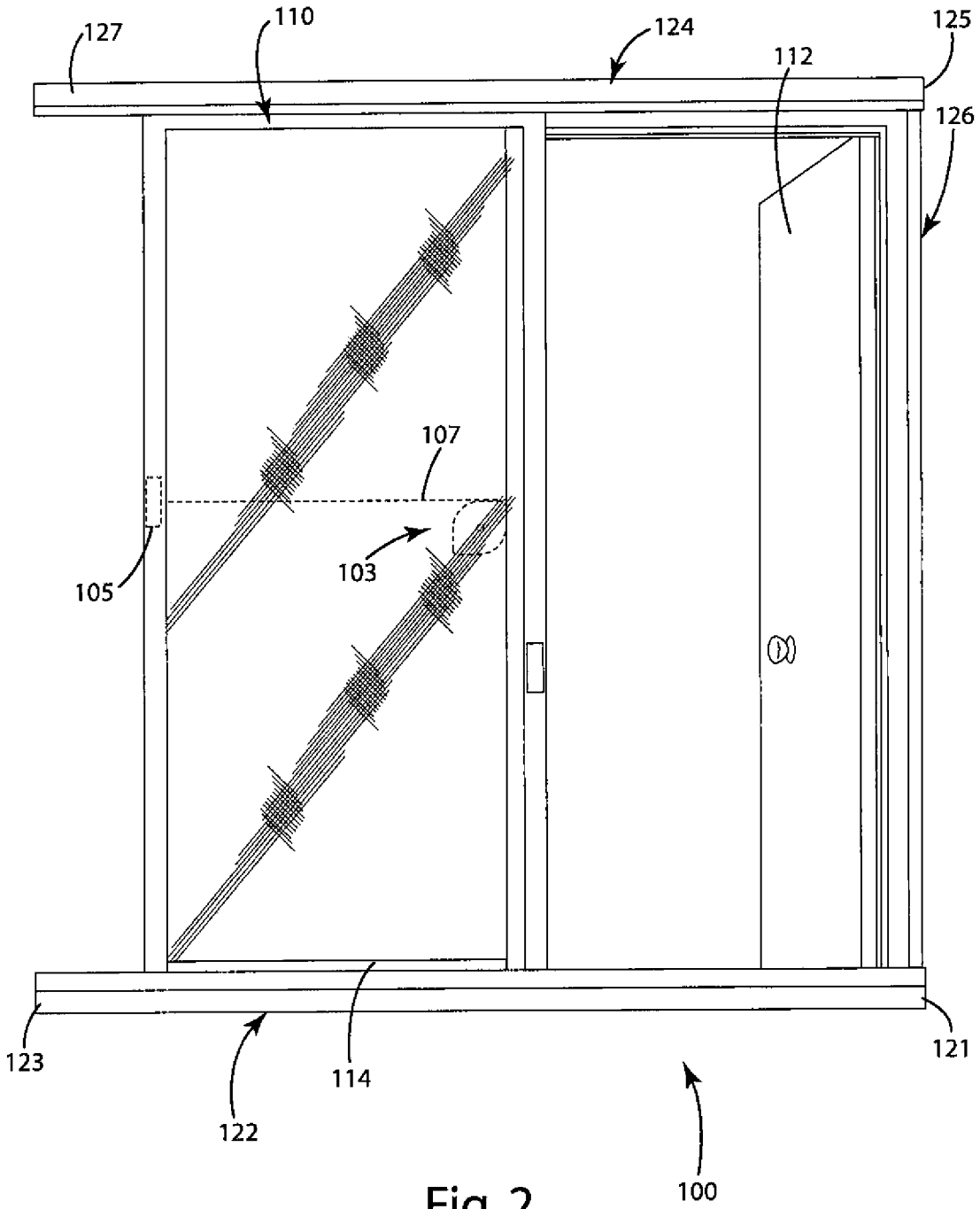
FIG. 2 is a front, elevation view of the sliding screen door mechanism shown in FIG. 1, and with the sliding screen door being shown in an open position in solid line format, and with a separate entry door being shown in an open or partially open position, and further showing an example self-closing device.

A first embodiment of a sliding screen door mechanism in accordance with the invention is illustrated as screen door mechanism 100 in FIGS. 1-6, and discussed in the immediately following paragraphs. In particular, FIGS. 1 and 2 provide an illustration of how the three principal components of the sliding door screen mechanism work together so as to complete the system. These drawings also demonstrate the screen door itself in the closed and open/stored positions, and clearly show that the screen door is truly self storing and out of the way, so that the main door entry is completely unhindered. This is distinguishable from conventional hung screen doors, which are attached to common service doors. Also, although not specifically shown in FIGS. 1 and 2, it will be made apparent from subsequent disclosure herein that door stops can be included on the top and bottom channels. The screen door mechanism 100 can include a screen door 110, with a slide frame or screen door frame 102. The slide frame 102 is adapted to at least partially circumscribe an entry door 112 and includes a bottom channel 122, a top channel 124, and a side channel 126. As particularly shown in FIGS. 1 and 2, the bottom channel 122 can be characterized as having a first bottom channel end 121 and an opposing second bottom channel end 123. Correspondingly, the top channel 124, as also shown in FIGS. 1 and 2, can have a first top channel end 125 and an opposing top channel end 127. Still further, the side channel 126 can include an upper end 129 and a lower end 131. As shown particularly in FIG. 3, the bottom channel 122 may be an elongated and generally Z-shaped member with a bottom web 132 that extends along a length of the channel 122. The bottom web 132 has two opposite lateral edges. The lateral edges can be characterized as a first lateral edge 138 and a second lateral edge 140. A bottom mount 134 is provided at the bottom web edge 138. Correspondingly, a door track 136 is provided at the second lateral web edge 140. The bottom channel 122 may be constructed of any suitable structural material and by any process that is suitable to the selected material. An aluminum alloy extrusion is anticipated as a common fabrication, for example. The first end 121 of the bottom channel 122 is positioned adjacent the screen door 110 when the screen door 110 is in a closed position. The opposing second end 123 of the bottom channel 122 can be adjacent to a side of the screen door 110, when the screen door 110 is in a fully opened position. In this regard, it can be seen that it may be preferable to have the length of the bottom channel be at least twice the width of the screen door 110, for purposes of accommodating the screen door 110 when in fully opened and closed positions. Also, as an option, FIG. 2 illustrates a self-closing device 103 for automatically returning the screen door 110 to a closed position after it has been opened. Such closing devices 103 are well known and commercially available, and a number of different types of closers may be utilized. In FIG. 2, the device 103 is shown with a closer mount 105 connected to a spring 107 coupled to the door 110.

The bottom mount 134 is adapted to mount the bottom channel 122 to a generally vertical surface as is known to surround an entry door 112. More specifically, and as shown in detail in FIG. 3, the bottom mount 134 may be a flange portion and may further be adapted with spaced apertures 142 to screw fasten the bottom channel to the surface surrounding the door. Although, one having ordinary skill in the art realizes that alternative fastenings may be used.

The bottom door track 136 may be a flange portion as shown, that is adapted to cooperate with the door 110 in sliding engagement. More specifically, the door has a bottom edge 114 (FIGS. 1 and 2) that may be provided with grooved wheels (not shown) that are adapted to receive and roll along a rail, including track 136, as is known by one having ordinary skill in the art.

Figure 6:
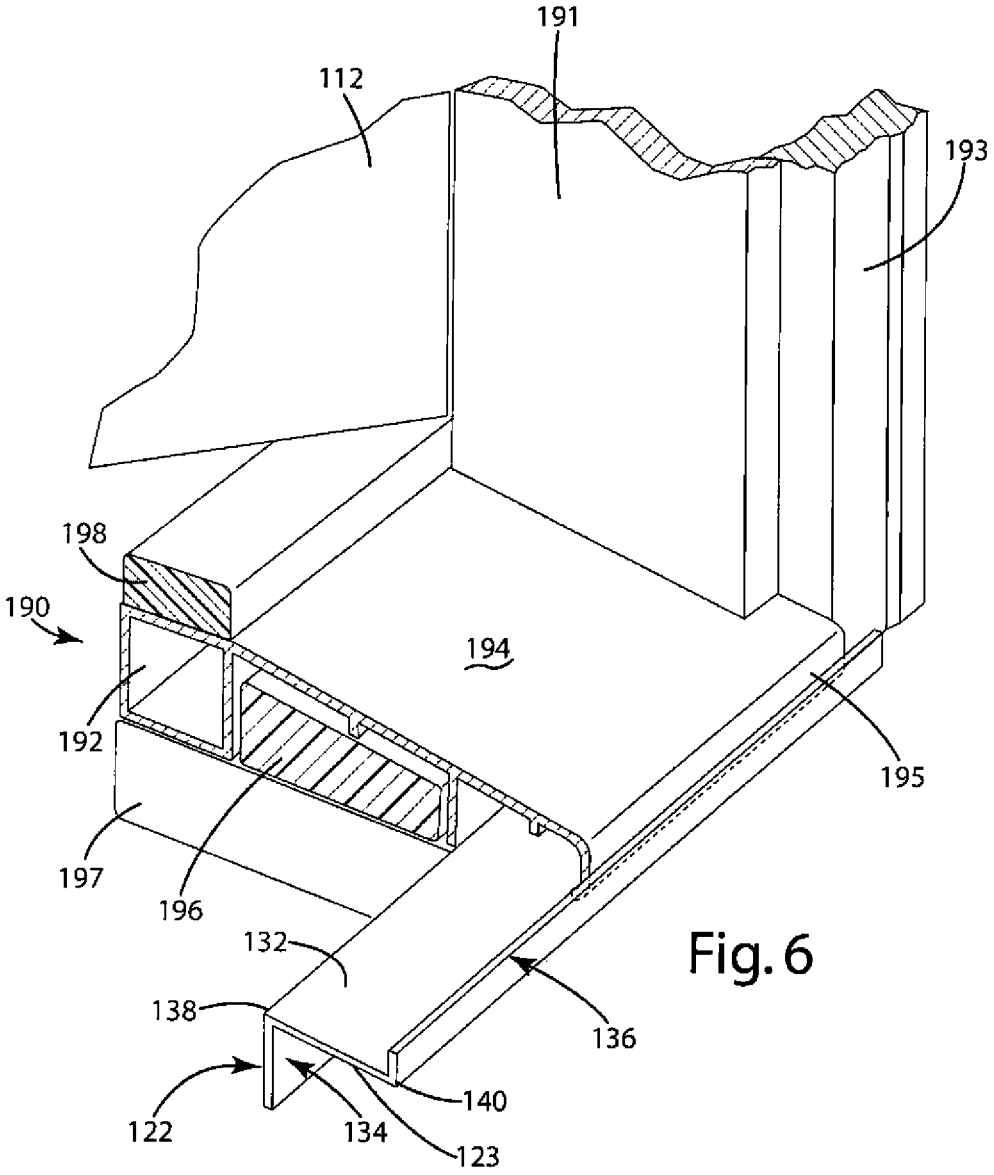
FIG. 6 is a fragmented perspective view of the bottom channel installed at a door threshold, the view particularly showing how the bottom channel essentially tucks under the threshold, with the figure expressly showing a top cut out view of the threshold and further showing the bottom channel with no vertical surface.

FIG. 6 is a fragmented perspective view of the channel 122 as installed within a door threshold 190. FIG. 6 also shows, in partial and cutout view, a portion of the entry door 112. FIG. 6 also particularly shows how the bottom channel 122 essentially tucks under the threshold 190, and further essentially shows a top cutout view of the threshold 190 and showing the bottom channel 122 in the absence of a vertical surface. With reference specifically to the threshold 190, the threshold 190 can be characterized as incorporating a hollow box 192 positioned under the entry door 112. The threshold 190 also includes a substantially planar portion 194 extending from the hollow box 192 to the bottom door track 136. In addition, the threshold 190 also includes a vertical portion 195. The vertical portion 195 is preferably integral with the planar portion 194. FIG. 6 also illustrates the position of the vertical door jamb 191, relative to a section of brick molding 193. Below the planar portion 194 of the threshold 190 is a section 196 which may consist of wood or composite filler. Below the section 196 is a subfloor 197. Positioned above the subfloor 197 and the hollow box 192 is an adjustable sill 198.

Further with respect to FIG. 6, it should be noted that the brick moldings 193 (also often referred to as trim moldings) used around doors are often of a uniform thickness. Accordingly, a door threshold 190 extends outwardly a standard distance from a surface surrounding the door. For this reason, the web 132 of the bottom channel 122 may have a whip which centers the bottom door track 136 a distance of approximately 1.625 inches away from the vertical surface or wall surrounding the entry door 112. Similarly, door thresholds are often a standard dimension, so that the bottom door track 136 may typically extend approximately 1.0 inches above the web 132. Still further, the bottom channel mount 134 may extend about 1.0 inches downwardly from the web 132.

The length of the bottom channel 122, and also the top channel 124, is dictated by the width of the door 112 and its associated trim. The sliding screen door 110 will preferably have a width that is wide enough for the screen door to overlay and cover the entry door 112 and its side trims. In order for the screen door 110 to slide clear of the entry door 112, the lengths of the bottom and the top channels 122, 124, respectively will preferably be at least twice the width of the screen door 110. An additional margin of length of about 0.5 inches should be added to the top and the bottom channels 122, 124 to allow for the top channel stop 182, which is discussed further in subsequent paragraphs herein.

Figure 4:
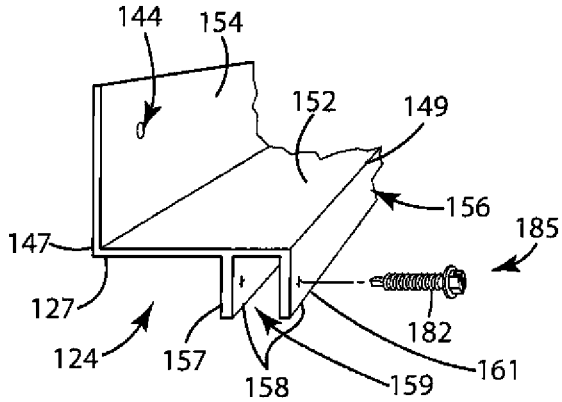
FIG. 4 is an end perspective and partial view of an alternative embodiment of a top channel of the sliding screen door mechanism, showing a top door stop in the form of a self-capping screw (the standard embodiment of a top channel in accordance with the invention being shown in FIG. 13)

Similar to the bottom channel 122, the top channel 124 may be an elongated member with a top web 152 that extends horizontally along a length of the channel 124. This configuration of the top channel 124 is illustrated in FIG. 4. It should be noted that the top channel 124 shown in FIG. 4 has a somewhat different configuration than what may be characterized as a channel for fitting standard screen doors. With respect to standard screen doors, FIG. 13 (discussed in subsequent paragraphs herein) illustrates a top channel 502 which may be characterized as the "standard" top channel. With reference briefly back to FIG. 1, the top channel 124 also has a first end 125 located adjacent a side of the screen door 110 when the screen door 110 is in a fully closed position. The top channel 124 further has a second opposing end 127 (expressly shown in FIG. 4), which may be located adjacent a side of the screen door 110 when the screen door 110 is in a fully open position. Referring back to FIG. 4, the top web 152 has two opposite lateral edges. These opposing lateral edges are referred to in FIG. 4 as a first lateral edge 147 and a second lateral edge 149. A top mount 154 is provided at the first lateral edge 147 and extends upwardly therefrom. Correspondingly, a top door track 156 is provided at the other web edge 149, and extends downwardly therefrom. As with the bottom channel 122, the top channel 124 may be also be constructed of any suitable structural material and by any process that is suitable to the selected material. An aluminum alloy extrusion is anticipated as a common fabrication for the top channel 124 as well as the bottom channel 122.

With further reference to FIG. 4, the top door track 156 includes a pair of downwardly extending and substantially parallel vertical flanges 158 that are adapted to cooperate with the door 110 in sliding engagement. The vertical flanges 158 are shown in FIG. 4 as comprising an inner flange 157 and an outer flange 161. The outer flange 161 is aligned and extends directly downwardly from the lateral edge 149. More specifically, the flanges 158 (in combination with a portion of the web 152 extending between the flanges 158 at the upper portions thereof) provide a downward opening U-shaped channel portion 159 that is adapted to receive a top of the door 110 in sliding engagement. The flanges 158 may extend down about 2.0 inches from the web 152. A lateral spacing of the flanges 158 to define a clear space of about 0.625 inches between the flanges 158 may be used, although this specific dimension is not critical to the invention and the spacing of the flanges 158 in a given installation will be determined by the screen door 110 used and, more particularly, by the thickness of the top of the door 110.

It is noted that the U-shaped channel 159 of the top door track 156 is relatively deep (meaning the distance of extension of the flanges 158 downwardly from the web 152) to accommodate convenient installation and subsequent re-seating of the door 110. Although the particular installation processes and movement are not specifically shown in the drawings, the screen door 110 may be slid into and onto the top and the bottom door tracks 136, 156, respectively, from an end of the tracks 136, 156, if sufficient room is provided in a particular installation and door stops, discussed below, are removed or otherwise not installed. However, with sufficient depth of the channel 159, the screen door 110 can be conveniently seated and installed at any point along the top and bottom channels 124, 122, respectively, without requiring space at the end of a slide frame. That is, the top of the screen door 110 may be inserted into the channel 159 sufficiently far so that the bottom of the door 110 may be located above and aligned with the bottom door track 136. The screen door 110 may then be lowered on to the bottom door track 136. This maneuvering of the screen door 110 to seat the bottom of the door 110 onto the bottom door track 136 with the top of the door captured in the channel 159 is allowed by the depth of the U-shaped channel 159 of the top door track 156. The depth of the channel 159 may be said to accommodate "over insertion" of the screen door 110 into the channel 159.

The top channel mount 154 is adapted to mount the top channel 124 on a generally vertical surface (the vertical surface not being shown in FIG. 4) that surrounds the entry door 112, in a manner similar to the mounting of the bottom channel 122. Thus, the top mount 154 may consist of a flange portion provided with spaced apertures 144 (only one of the apertures 144 being shown in FIG. 4) to screw fasten the top channel 124 to the surface surrounding the door. The top channel mount 154 may extend about 1.0 inches up from the web 152 at the lateral edge 147. As noted above with respect to the bottom channel mount 134, alternative fastenings may similarly be used for the top channel mount 154.

Again, the bottom channel 122 extends from, and the bottom door track 136 is thereby spaced from, the vertical surface or wall which surrounds the entry door 112. The purpose for this spacing is to properly position the screen door 110 in view of the extensions of each of the entry door trim moldings and their threshold. Further, the top channel 124 may also extend from the vertical surface or wall surrounding the entry door. While the bottom door track 136 may be centered about 1.625 inches away from the wall as discussed above, the top door track 156 may also be centered about 1.625 inches away from the wall to align the bottom and the top door tracks 136, 159, which orients the screen door 110 generally parallel with the entry door 112 and with the surrounding wall into which the entry door 112 is installed.

Figure 5:
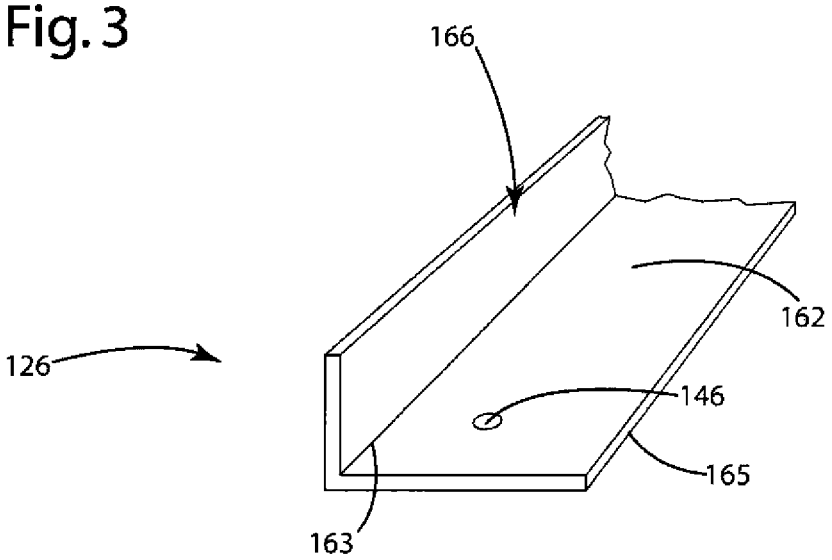
FIG. 5 is an end perspective and partial view of a side channel of the mechanism.

The side channel 126 is illustrated in FIG. 5 and may also be an elongated member with a side web 162 that extends along a length of the side channel 126 and a side flange 166 that extends along at least a portion of the side channel length. The side web 162 has two opposing lateral edges. These lateral edges are identified in FIG. 5 as a first lateral edge 163 and a second lateral edge 165. The side flange 166 extends upwardly from the first lateral edge 163. Again, as with the bottom and the top channels 122, 124, respectively, the side channel 126 may be constructed of any suitable structural material and by any process that is suitable to the selected material. An aluminum alloy extrusion is anticipated as a common fabrication.

As further shown in FIG. 5, the side channel web 162 is the side channel mount and may have a width of about 1.5 to 1.875 inches with apertures 146 (only one of the apertures 146 being shown in FIG. 5) for screw mounting as discussed above relative to each of the bottom and the top channels 122, 124, respectively. The side flange 166 provides a strike or stop for the sliding screen door 110 in a closed position (FIG. 1), and also provides a latch mounting jamb. While the side channel 126 may extend between respective first ends of the bottom and the top channels 122 and 124, respectively, and a screen door jamb at the entry door 112, separate stops may be provided at respective opposite second ends of the bottom and the top channels.

Figure 3:
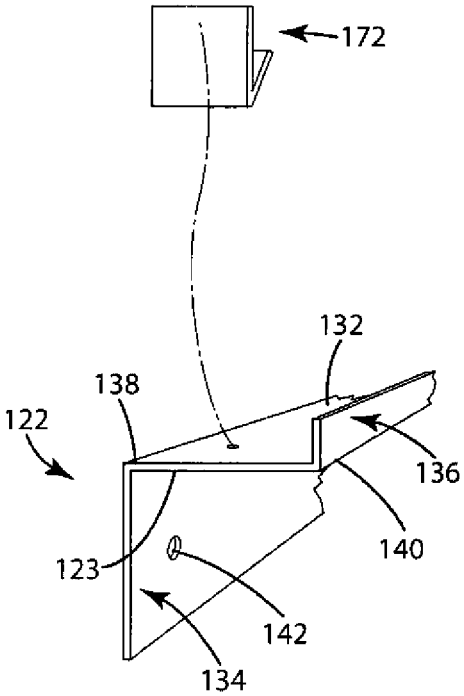
FIG. 3 is an exploded and perspective view of a portion of a bottom channel of the mechanism, and showing a bottom door stop, and further showing how the bottom door track raises upwardly from the bottom web, with the upward raise potentially being 0.5625 inches, with the dimension capable of fluctuating from 1.0 to 2.0 inches.

More specifically, and as shown in FIG. 3, a bottom channel stop 172 may include a block or an L-shaped bracket as shown. The bottom stop 172 is located and mounted at the second end 123 of the bottom channel 122. Further, the bottom stop 172 blocks the screen door 110 from sliding off the end 123 of the bottom channel 122. A top stop 182 may also be provided at the second end of the top channel 124. The top stop 182 (as illustrated in FIG. 4) may be conveniently constructed with a self-tapping screw 185 extending through both of the flanges 158. The screw 185 therefore is extended through the U-shaped channel 159 near the top channel end 127. It should be noted that alternative means for providing the stop may also be utilized. In accordance with the foregoing, the top stop 182 blocks the screen door 110 from sliding off the end of the top channel 124. While one or the other of the bottom and the top stops, 172 and 182 respectively, may be used individually, they may also be used together. The top and the bottom stops 172, 182 are preferably aligned with one another when both the bottom and the top stops 172, 182 are used.

Various other embodiments of sliding screen door mechanisms in accordance with the invention have been conceived. The following paragraphs describe several of these additional embodiments.

Figure 7:
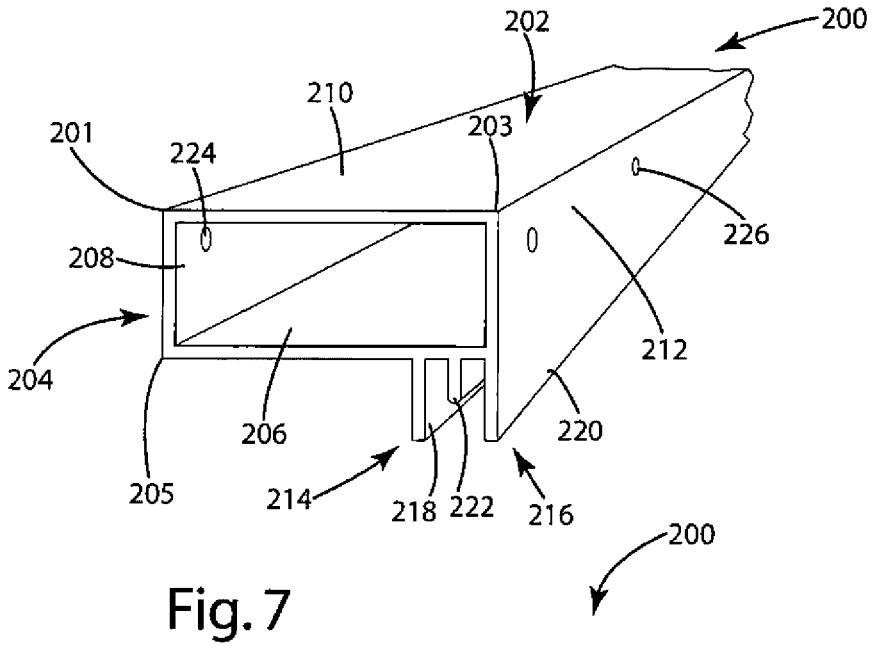
FIG. 7 is a front end perspective view of another embodiment of a sliding screen door mechanism in accordance with the invention, and illustrating an embodiment of a top channel thereof, with the top channel having a box-like configuration.
Figure 8:
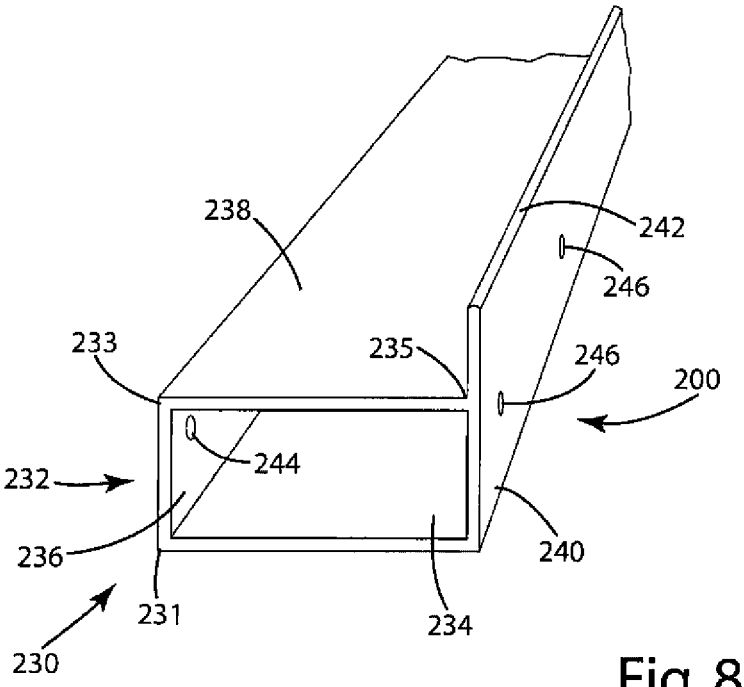
FIG. 8 is a front end perspective view of a bottom channel of a sliding screen door mechanism in accordance with the invention, adapted for use with the top channel shown in FIG. 7, with the bottom channel having a box-like configuration similar to the box-like configuration of the top channel shown in FIG. 7.

One embodiment is illustrated in FIGS. 7 and 8, and is identified as sliding screen door mechanism 200. In fact, the reference numeral "200" is somewhat symbolic, in that neither FIG. 7 nor FIG. 8 shows an entirety of the sliding screen door mechanism 200. Instead, FIG. 7 illustrates a top channel 202, while FIG. 8 illustrates a bottom channel 230. Accordingly, the numerical reference "200" should be construed as meaning a sliding screen door mechanism in accordance with the invention which may employ concepts associated with the top channel 202 and/or concepts associated with the bottom channel 230.

Turning to the drawings, and specifically FIG. 7, the top channel 202 is similar in structure and function to the top channel 124 previously described herein and illustrated in FIG. 4. However, unlike the previously described top channel 124, the top channel 202 of the screen door mechanism 200 includes a box-like configuration comprising a channel box 204. The channel box 204 includes a horizontally disposed top channel web 206. Extending upwardly at a right angle from one edge 205 of the top channel web 206 is an inner top channel connecting mount 208. The inner top channel connecting mount 208 is similar in structure and function to the top mount 154 of the previously described top channel 124. The inner top channel connecting mount 208 may preferably be integral with the top channel web 206.

Extending outwardly from an upper edge 201 of the inner top channel connecting mount 208 is a horizontally disposed top channel box cover 210. With continued reference to FIG. 7, at an outer longitudinal edge 203 of the top channel box cover 210, an outer top channel connecting mount 212 extends downwardly therefrom. Preferably, the top channel box cover 210 may be integral with the inner top channel connecting mount 208, and the outer top channel connecting mount 212 may be integral with the top channel box cover 210.

Extending downwardly from the outer portion of the top channel web 206 of the top channel box 204 is a top door channel 214, as also shown in FIG. 7. The top door channel 214 is similar in structure and function to the channel 159 previously described herein with respect to the top channel 124 and illustrated in FIG. 4. With further reference thereto, the channel 214 includes a pair of top track flanges 216. The flanges 216 include an inner top track flange 218 and an outer top track flange 220. Each of the flanges 216 depends downwardly from the top channel box 204 and are vertically disposed when the top channel 202 is installed. Also, the outer top track flange 220 may be integral with the outer top connecting mount 212.

Figure 27:
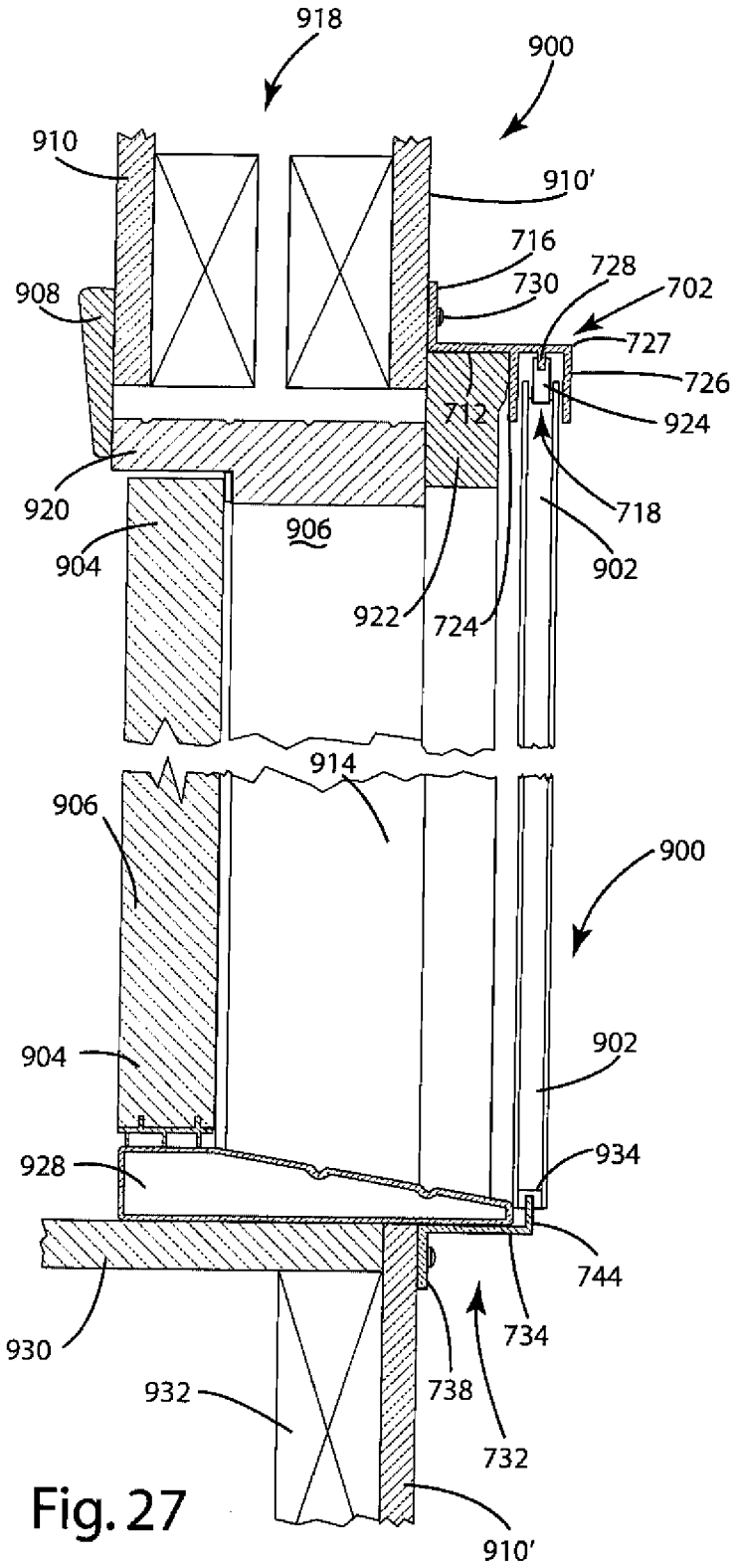
FIG. 27 is a partial side view showing, in an enlarged format, the relative configurations of the top channel and bottom channel of the sliding screen door mechanism in accordance with the invention, which is also illustrated as being installed on the building structure as shown in FIGS. 24, 25 and 26.

In addition to the top track flanges 216, the top door track 214 also includes a top channel door rail 222. As further shown in FIG. 7, the top channel door rail 222 is elongated and depends downwardly from the top channel web 206. Preferably, the top door rail 222 is spaced so as to be intermediate the pair of top track flanges 216, and equidistant from the inner top track flange 218 and the outer top track flange 220. The top door rail 222 functions with rollers, bearings, or similar types of devices mounted on the screen doors themselves (at the tops thereof) so as to provide for a surface for rolling motion. The use of a top door rail 728 with a set of screen door top rollers 924 is illustrated in FIG. 27. With the particular embodiment of the screen door mechanism 200 illustrated in FIG. 7, it is apparent that the vertical height of the top door rail 222 is somewhat shorter than the vertical height of each of the top track flanges 216. This height difference provides for the facilitation of installation of the screen door 110 on the top channel 202 and also facilitates stabilization of the screen door 110 when it is being slid along the top door rail 222.

As with the top channel 124 previously described herein, the track flanges 216 of the channel 214 may be relatively deep so as to accommodate convenient installation and subsequent re-seating of the screen door 110. That is, the screen door 110 may be slid into and onto the channel 214 from an end of the track, if sufficient room is provided in a particular installation and door stops are removed or otherwise not installed. However, more conveniently, and requiring no space at an end of the top channel 202, the screen door 110 may be conveniently seated and installed at any point along the top channel 202 by inserting the top of the screen door 110 into the channel 214 sufficiently far so that the bottom of the screen door 110 may be located above and aligned with a bottom door track 242. The screen door 110 may then be lowered onto the bottom door track 242. The maneuvering of the screen door 110 to seat the bottom of the door onto a bottom door track 242 with the top of the door 110 captured in the top door track 214 is allowed by the depth of the channel 214. As earlier described herein, with respect to the channel 159 illustrated in FIG. 4, the depth of the channel 214 may be characterized as accommodating "over insertion" of the sliding screen door 110 into the channel 214.

As with the previously described top channel 124, the inner top connecting mount 208 of the top channel 202 may include a set of inner top mount spaced apertures 224, one of which is illustrated in FIG. 7. As with the top mount 154 of the top channel 124 previously described herein, the inner top connecting mount 208 is adapted to mount the top channel 202 onto a generally vertical surface surrounding an entry door 112. Mounting may occur through the use of screws or similar connecting means received through the spaced apertures 224 so as to fasten the top channel 202 to the surface surrounding the door 112.

In addition to the inner top mount spaced apertures 224 positioned within the inner top connecting mount 208, the outer top connecting mount 212 also has a series of outer top mount spaced apertures 226, as shown in FIG. 7. More specifically, FIG. 8 illustrates two of the spaced apertures 226. The spaced apertures 226 do not receive any type of permanent screws or other mounting elements. Instead, the apertures 226 may be aligned with the apertures 224 in a manner so that the installer may insert a screwdriver or other similar means through the apertures 226 for purposes of securing screws or other connecting elements into the apertures 224.

In addition to the top channel 202 illustrated in FIG. 7, the sliding screen door mechanism 200 can also be characterized as including a bottom channel 230 as illustrated in FIG. 8. As with the prior description herein of the top channel 202, reference will be made to the screen door 110 and the entry door 112, although neither of the doors is illustrated in FIGS. 7 and 8. However, each of the doors 110 and 112 has been previously described herein. The bottom channel 230 is somewhat similar in structure and function to the bottom channel 122 previously described herein and illustrated in FIG. 3. However, unlike the previously described bottom channel 122, the bottom channel 230 of the screen door mechanism 200 includes a box-like configuration comprising a bottom channel box 232. The bottom channel box 232 is adapted to be utilized with the top channel box 204 previously described herein with respect to FIG. 7. More specifically, the bottom channel box 232 includes a horizontally disposed bottom channel web 234. Extending upwardly at a right angle from one edge 231 of the bottom channel web 234 is an inner bottom channel connecting mount 236. The inner bottom channel connecting mount 236 is similar in structure and function to the bottom mount 134 of the previously described bottom channel 122. The inner bottom channel connecting mount 236 may preferably be integral with the bottom channel web 234.

Extending outwardly from an upper edge 233 of the inner bottom channel connecting mount 236 is a horizontally disposed bottom channel box cover 238. With continued reference to FIG. 8, at an outer longitudinal edge 235 of the bottom channel box cover 238, an outer bottom channel connecting mount 240 extends downwardly therefrom. Preferably, the bottom channel box cover 238 may be integral with the inner bottom channel connecting mount 236, and the outer bottom channel connecting mount 240 may be integral with the bottom channel box cover 238.

Extending upwardly from the intersection of the outer edge 235 of the bottom channel box cover 128 and an upper edge of the outer bottom channel connecting mount 240 is a bottom door track 242, having the elongated and longitudinal configuration as illustrated in FIG. 8. The bottom door track 242 is similar in structure and function to the bottom door track 136 previously described herein with respect to the bottom channel 122 and illustrated in FIG. 3. With further reference to FIG. 8, the bottom door track 242 as shown in FIG. 8 may be a flange portion, adapted to cooperate with the sliding door 110 in a sliding engagement. More specifically, and as previously described herein, the sliding door 110 may have a bottom edge 114 that may be provided with grooved wheels, rollers, bearings or similar devices that are adapted to receive and roll along a rail, including the rail formed by the bottom door track 242.

As further shown in FIG. 8, the inner bottom channel connecting mount 236 may be formed with a series of spaced apart apertures 244 extending horizontally therethrough (only one of the apertures 244 is illustrated in FIG. 8). The apertures 244 are utilized with connecting screws or similar connecting means (not shown) for purposes of securing the inner bottom connecting mount 236 to a generally vertical surface (not shown) as is typically known to surround the entry door 112. It will be apparent to those of ordinary skill in the art that numerous types of connecting means may be utilized.

In addition to the inner bottom mount spaced apertures 244 positioned within the inner bottom connecting mount 236, the outer bottom connecting mount 240 also includes a series of outer bottom connecting mount spaced apertures 246 spaced apart in a horizontal plane within the outer bottom connecting mount 240. More specifically, FIG. 8 illustrates two of these outer bottom connecting mount spaced apertures 246.

Still further embodiments of sliding screen door mechanisms in accordance with the invention are available without departing from the principal concepts of the invention.

Figure 9:
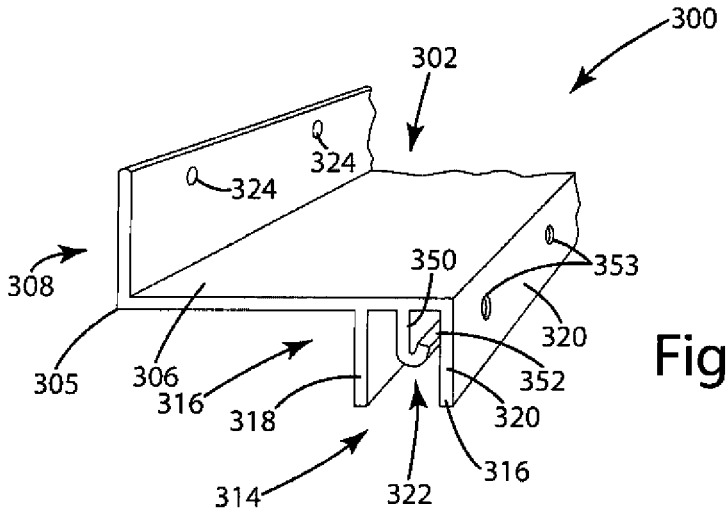
FIG. 9 is a front end perspective view of a further embodiment of a top channel of a sliding screen door mechanism in accordance with the invention, with the top channel having a pair of downwardly directed flanges with a roller catch positioned between the flanges, for purposes of supporting a single roller assembly of a screen door.
Figure 10:
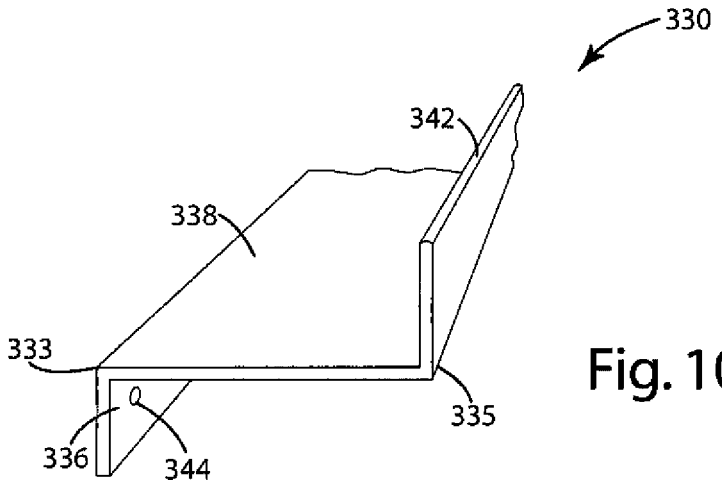
FIG. 10 is a front end perspective view of a bottom channel of a sliding screen door mechanism in accordance with the invention, adapted for use with the top channel shown in FIG. 9.
Figure 11:
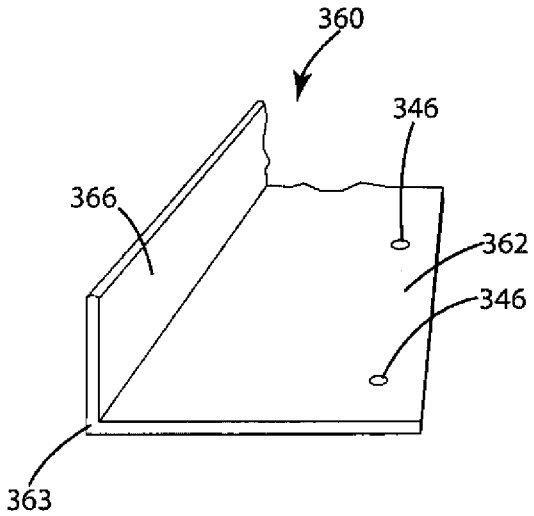
FIG. 11 is an end perspective view of a side channel of a sliding screen door mechanism in accordance with the invention, with the side channel shown in FIG. 11 adapted for use with the top channel shown in FIG. 9 and bottom channel shown in FIG. 10.

Such a further embodiment is illustrated in FIGS. 9, 10 and 11, and is identified as sliding screen door mechanism 300. As with the previously described sliding screen door mechanism 200, the reference numeral "300" is somewhat symbolic, in that none of FIG. 9, 10 or 11 show an entirety of the sliding screen door mechanism 300. Instead, FIG. 9 illustrates a top channel 302, FIG. 10 illustrates a bottom channel 330 and FIG. 11 illustrates a side channel 360. Accordingly, the numerical reference "300" should be construed as meaning a sliding screen door mechanism in accordance with the invention which may employ concepts associated with the top channel 302, bottom channel 330 and/or side channel 360.

Turning to the drawings, and specifically FIG. 9, the top channel 302 is similar in structure and function to the top channel 124 previously described herein and illustrated in FIG. 4. However, unlike the previously described top channel 124, and as described in greater detail herein, the top channel 302 of the screen door mechanism 300 includes a top channel door rail that has a top door track or channel 314 which is distinguishable from the channel 159 illustrated in FIG. 4. The top channel 302 includes a horizontally disposed top channel web 306. Extending upwardly at a right angle from one edge 305 of the top channel web 306 is an inner top channel connecting mount 308. The inner top channel connecting mount 308 is similar in structure and function to the top mount 154 of the previously described top channel 124. Preferably, the top channel web 306 may be integral with the inner top channel connecting mount 208.

Extending downwardly from the outer portion of the top channel web 306 is a top door channel 314, as also shown in FIG. 9. The channel 314 is somewhat similar in structure and function to the channel 214 previously described herein with respect to the top channel 202 and illustrated in FIG. 7. With further reference thereto, the channel 314 includes a pair of top track flanges 316. The top track flanges 316 include an inner top track flange 318 and an outer top track flange 320. Each of the flanges 316 extends downwardly from the top channel web 306 and are vertically disposed when the top channel 302 is installed. Also, the top track flanges 316 may be integral with the top channel web 306.

In addition to the top track flanges 316, the channel 314 also includes a top channel door rail 322. The top channel door rail 322 differs in structure and somewhat in function relative to the top channel door track 222 previously described and illustrated in FIG. 7. More specifically, the top channel door rack 322 includes a vertically disposed and elongated section 350. Integral with and positioned at the lower end of the vertical leg 350 is a curled lip 352, again specifically shown in FIG. 9. The top channel door rail 322 is spaced intermediate the pair of top track flanges 316. The top door rail 322 can operate with a known type of screen door which utilizes a roller or bearing device (not shown) which essentially "hooks" on the curled lip 352. The rollers or bearings thus provide a sliding engagement of the screen door 110. As with other embodiments of screen door mechanisms described herein, the vertical height of the top channel door rail 322 is somewhat shorter than the vertical height of each of the top track flanges 316. This height difference provides for the facilitation of installation of the screen door 110 on the top channel 302, and also facilitates stabilization of the screen door 110 when it is being slid along the top door rail 322.

Figure 9A:
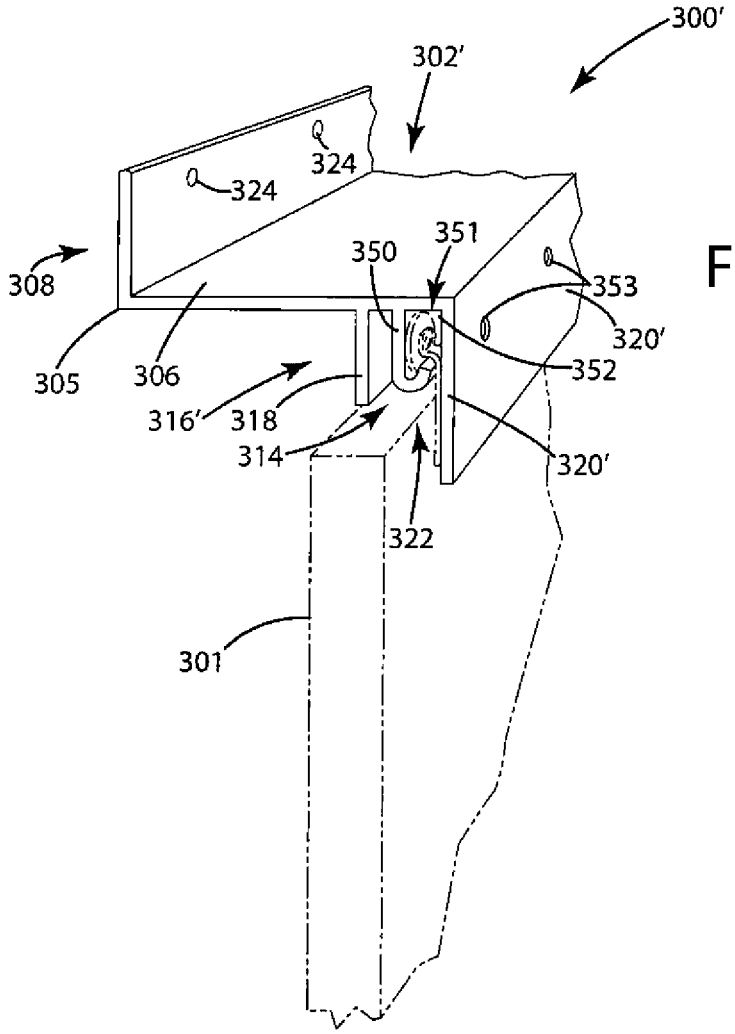
FIG. 9A is a front end perspective view of the embodiment of the top channel as shown in FIG. 9, but specifically showing the relative positioning of an upper roller assembly and an associated portion of the screen door.

FIG. 9A illustrates a top channel 302' as part of a sliding screen door mechanism 300'. The top channel 302' is extremely similar in structure and function to the top channel 302 previously described herein and illustrated in FIG. 9. However, as specifically shown in FIG. 9A, the top track flanges are identified as flanges 316'. The flanges 316' include an inner top track flange 318 (corresponding substantially to the flange 318 as shown in FIG. 9) and an outer top track flange 320'. As apparent from a comparison of FIGS. 9 and 9A, the outer top track flange 320' shown in FIG. 9A extends downwardly a greater distance from the top channel web 306 than does the top track flange 320 shown in FIG. 9. The purpose for this extended length is to cover a gap which may exist between the top of the combination screen door 301 (shown in FIG. 9A) and the bottom portion of the channel 314. Also, for purposes of clarification and detailed description, FIG. 9A illustrates a roller assembly 351 which rotatably mounts onto the vertical leg 350. Further, FIG. 9A shows a pair of roller adjustment access holes 353, for the purpose of a user accessing the roller assembly 351 when the combination screen door 301 is installed within the channel 314.

In addition to the top channel 302, the screen door mechanism 300 may also include a bottom channel 330 as expressly illustrated in FIG. 10. The bottom channel 330 is substantially similar in structure and configuration to the bottom channel 122 previously described with respect to FIG. 3. Returning to FIG. 10, the bottom channel 330 is elongated and may have a generally Z-shaped member with a bottom web 338 that extends along a length of the channel. The bottom web 338 has two opposite lateral edges, namely edges 333 and 335. Extending downwardly from the edge 333 is a bottom mount 336. Extending upwardly from the opposing edge 335 of the bottom mount 338 is a door track 342. The bottom channel 330 may be constructed of any suitable structural material, and by any process suitable to the selected material. An aluminum alloy extrusion is anticipated as a common fabrication, for example.

The bottom mount 336 may be adapted to mount the bottom channel 330 on a generally vertical surface as is typically associated with an entry door 112. As shown in FIG. 10, the bottom mount 336 may be a flange portion and may further be provided with spaced apertures 344 (only one of which is shown in FIG. 10) to screw fasten the bottom channel 330 to a surface (not shown) surrounding the screen door 110. Alternative fastenings may also be used. The bottom door track 342 may be a flange portion as shown, adapted to cooperate with the screen door 110 in a sliding engagement. As previously described with respect to the bottom channel 122 shown in FIG. 3, the screen door 110 may have a bottom edge which is provided with grooved wheels or rollers adapted to receive and roll along a rail, such as the track 342.

The screen door mechanism 300 may also include a side channel 360, such as the side channel 360 illustrated in FIG. 11. The side channel 360 is similar in structure and function to the side channel 126 previously described herein and illustrated in FIG. 5. More specifically, the side channel 360 may be an elongated member having a side web 362 that extends along a length of the side channel 360. A side flange 366 may extend in a perpendicular direction from the side web 362 at an edge 363 of the side web 362. As with the top channel 302 and bottom channel 330, the side channel 360 may be constructed of any suitable structural material and by any process suitable to the selected material. Again, an aluminum alloy extrusion may be anticipated as a common fabrication.

The side channel web 362 may include a series of apertures 346 (two of which are shown in FIG. 11) for purposes of screw mountings as previously discussed herein with respect to the bottom and top channels 330, 302, respectively. The side flange 366 may provide a strike or stop for the sliding screen door 110 in a closed position, and can also provide a latch mounting jamb. While the side channel 360 may extend between respective first ends of the bottom and top channels 330, 302, respectively, and a screen door jamb at the entry door 112, separate stops may be provided at respective opposite second ends of the bottom and top channels. Such stops were previously described herein and illustrated in FIGS. 3 and 4.

Although the top, bottom and side channels of the screen door mechanism 300 are similar in structure and function to the equivalent components of screen door mechanism 100, it is apparent from the illustrations that sizing is shown as being somewhat different. For example, in FIG. 11, the side channel web 362 is shown as being substantially wider than the side channel web 162 shown in FIG. 5. It should be expressly noted that screen door mechanisms in accordance with the invention may be of various sizes for purposes of accommodating various sizes and structures of screen doors, entry doors, moldings and the like.

Figure 12:
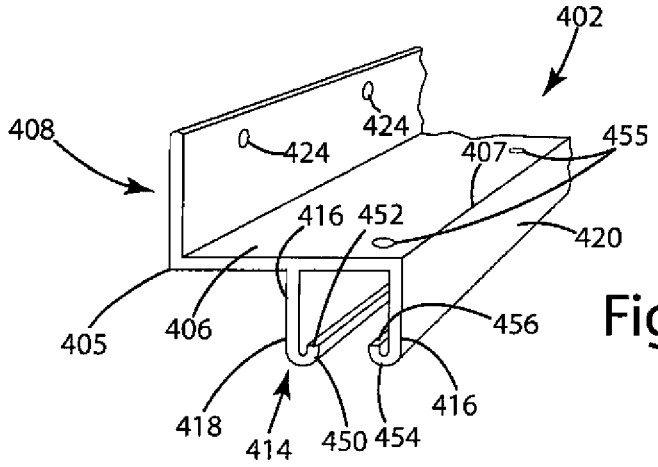
FIG. 12 is a front end perspective view of a still further embodiment of a top channel of a sliding screen door mechanism in accordance with the invention, with the top channel having downwardly directed flanges which form a pair of opposing roller slots for slideably receiving a pair of roller assemblies at the top portion of a screen door.

In accordance with the foregoing description, the top channel 302 illustrated in FIG. 9 incorporated a particular configuration of a door track 314. Other embodiments of screen door mechanisms in accordance with the invention (and the components associated therewith) may take on other sizes, shapes and configurations, without departing from the principal novel concepts of the invention. For example, FIG. 12 illustrates a top channel 402 which may be utilized in accordance with the invention, and primarily differs from the top channel 302 shown in FIG. 9 with respect to the configuration of the top U-shaped channel. The top channel 402 includes a horizontally disposed top channel web 406. Extending upwardly at a right angle from one edge 405 of the top channel web 406 is an inner top channel connecting mount 408. The inner top channel connecting mount 408 is similar in structure and function to the top mount 308 of the previously described top channel 302. The inner top channel connecting mount 408 may preferably be integral with the top channel web 406.

Extending downwardly from the outer portion of the top channel web 406 is a U-shaped channel 414, as further shown in FIG. 12. The channel 414 is somewhat similar in structure and function to the channel 314 previously described herein with respect to the top channel 302 and illustrated in FIG. 9. With further reference thereto, the channel 414 includes a pair of top track flanges 416. The top track flanges 416 include an inner top track flange 418 and an outer top track flange 420. Each of the flanges 416 extends downwardly from the top channel web 406 and are vertically disposed when the top channel 402 is installed. Also, the top track flanges 416 may be integral with the top channel web 406. More specifically, the outer top track flange 420 is shown as extending directly downwardly from an edge 407 of the top channel web 406.

In addition to the top track flanges 416, the channel 414 includes a rail configuration which is distinguishable from the rail configurations previously described herein. More specifically, the rail configuration includes a top channel inner door rail 450 which is preferably integral with the bottom of the inner top track flange 418. The top channel inner door rail 450 includes an upwardly curving lip 452 as expressly shown in FIG. 12. In a similar manner, a top channel outer door rail 454 is preferably integral with the bottom portion of the outer top track flange 420. The top channel outer door rail 454 includes an upwardly projecting lip 456 which curves inwardly toward the lip 452 associated with the top channel inner door rail 450. Although not specifically shown in FIG. 12, a pair of rollers, bearings or other slidable elements can slidably be received within the lips 452 and 456 as part of a configuration of a screen door 110 which may be utilized with the inner door rail 450 and the outer door rail 454. Further, in view of the fact that rollers or similar elements may be utilized within the channel 414, the top channel web 406 includes a series of roller adjustment access holes 455, for purposes of permitting a user to adjust a roller assembly when the screen door is installed within the top channel 402.

It should be noted that the particular top channel 402 described herein and illustrated in FIG. 12 can be utilized with various types of screen doors and with various side channels and bottom channels previously described herein. In particular, it should be further noted that the top channel 402 illustrated in FIG. 12 is adapted to work with the bottom channel 330 illustrated in FIG. 10 and the side channel 360 illustrated in FIG. 11.

Figure 12A:
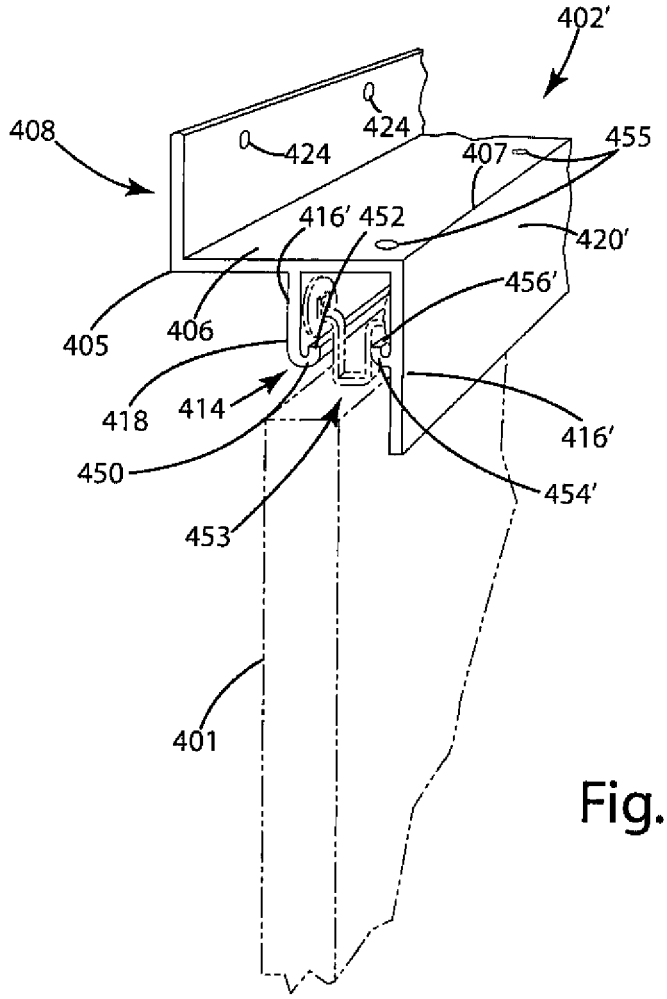
FIG. 12A is a front end perspective view of the embodiment of the top channel shown in FIG. 12, and specifically showing the relative positioning of a pair of roller assemblies as received on the roller slots, and further showing the relative positioning of a combination screen door and bottom channel, with the outer flange extending downwardly below a lower most portion of the inner flange, so as to cover an upper gap which may be associated with the screen door.

For purposes of clarification and detail, FIG. 12A illustrates a top channel 402', substantially similar to the top channel 402 illustrated in FIG. 12. However, in the top channel 402', the outer top track flange 420' extends downwardly a greater distance than the inner top track flange 418. Accordingly, the relationship between the outer top track flange 420' and the top channel outer door rail 454' is somewhat different than the relationship between the flange 420 and rail 454 as shown in FIG. 12. The purpose for extending the top track flange 420 downwardly a greater distance than flange 418 is to cover the gap which may exist between the upper portion of the combination screen door 401 and the lower portion of the channel 414. Also, for purposes of understanding, FIG. 12A illustrates the relative positioning of a roller assembly 453. FIG. 12A also shows the relative positioning and location of the upwardly projecting lip 456', relative to the top track flange 420'.

Figure 13:
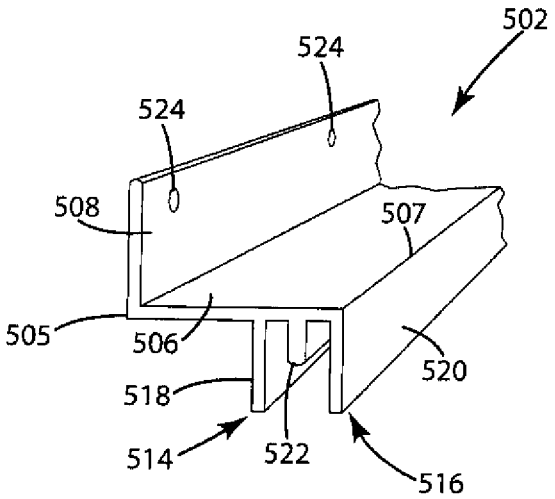
FIG. 13 is a front end perspective view of a still further embodiment of a top channel of a sliding screen door mechanism in accordance with the invention, with the top channel shown in FIG. 13 being characterized as a relatively standard top channel for use with a sliding screen door mechanism in accordance with the invention.

Another embodiment of a top channel which may be utilized in accordance with the invention is illustrated in FIG. 13 and described herein as top channel 502. With reference specifically to FIG. 13, the top channel 502 is similar in structure and function to the top channel 202 previously described herein and illustrated in FIG. 7. However, unlike the previously described top channel 202, the top channel 502 does not include any type of a box-like configuration comprising a channel box or the like. The top channel 502 includes a horizontally disposed top channel web 506. Extending upwardly at a right angle from one edge 505 of the top channel web 506 is an inner top channel connecting mount 508. The inner top channel connecting mount 508 is similar in structure and function to the top mount 208 of the previously described top channel 202. The inner top channel connecting mount 508 may preferably be integral with the top channel web 506.

Extending downwardly from the outer portion of the top channel web 506 is a top door track 514, also shown in FIG. 13. The top door track 514 is similar in structure and function to the top door track 214 previously described herein with respect to the top channel 202 and illustrated in FIG. 7. With further reference to FIG. 13, the top door track 514 includes a pair of top track flanges 516. The flanges 516 may include an inner top track flange 518 and an outer top track flange 520. Each of the flanges 516 extends downwardly from the top channel web 506 and is vertically disposed when the top channel 502 is installed. As shown further in FIG. 13, the outer top track flange 520 may depend directly downward from an edge 507 of the top channel web 506.

In addition to the top track flanges 516, the top door track 514 may also include a top channel door rail 522. As further shown in FIG. 13, the top channel door rail 522 is elongated and depends downwardly from the top channel web 506. Preferably, the top door rail 522 is spaced so as to be intermediate the pair of top track flanges 516, and equidistant from the inner top track flange 218 and the outer top track flange 220. The top door rail 522 functions with rollers, bearings, or similar types of devices mounted on the screen doors themselves (at the tops thereof) so as to provide for a surface for rolling motion. The use of a top door rail 728 with a set of screen door top rollers 924 is illustrated in FIG. 27.

With the particular embodiment of the top channel 502 illustrated in FIG. 13, it is apparent that the vertical height of the top door rail 522 is somewhat shorter than the vertical height of each of the top track flanges 516. This height difference provides for the facilitation of installation of the screen door 110 on the top channel 502, and also facilitates stabilization of the screen door 110 when it is being slid along the top door rail 522.

As with the top channel 202 previously described herein, the track flanges 516 of the top door track 514 may be relatively deep so as to accommodate convenient installation and subsequent re-seating of the screen door 110. That is, the screen door 110 may be slid into and onto the top door track 514 from an end of the track, if sufficient room is provided in a particular installation and door stops are removed or otherwise not installed. However, more conveniently, and requiring no space at the end of the top channel 502, the screen door may be conveniently seated and installed at any point along the top channel 502 by inserting the top of the screen door 110 into the top door track 514 sufficiently far so that the bottom of the screen door 110 may be located above and aligned with a bottom door track. The screen door 110 may then be lowered on to the bottom door track. The maneuvering of the screen door 110 to seat the bottom of the door onto a bottom door track with the top of the door 110 captured in the top door track 514 is allowed by the depth of the top door track 514. As earlier described herein, with respect to the top door track 156 illustrated in FIG. 4, the depth of the top door track 514 may be characterized as accommodating "over insertion" of the screen door 110 into the top door track 514.

It should also be noted that as with the top channel 402 previously described herein and illustrated in FIG. 12, the top channel 502 described herein and illustrated in FIG. 13 is adapted to be used with the bottom channel 330 illustrated in FIG. 11 and the side channel 360 illustrated in FIG. 11.

Figure 14:
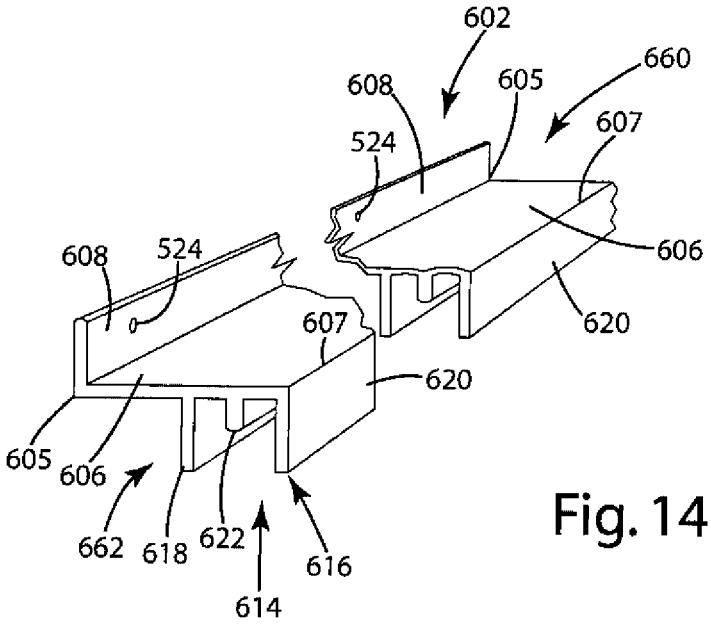
FIG. 14 is a front end perspective view of a still further embodiment of a top channel of a sliding screen door mechanism in accordance with the invention.
Figure 15:
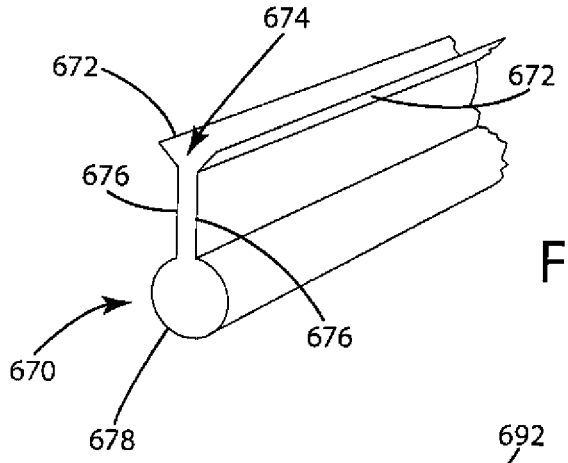
FIG. 15 is a partial, front end perspective view of a cap which may be utilized with the top channel shown in FIG. 14.

A further embodiment of a top channel which may be utilized in accordance with the invention, and which may facilitate the saving of component materials, is illustrated as top channel 602 in FIGS. 14 and 15. As shown in FIG. 14, the top channels 602 can be configured as end pieces of a typical, fully extending top channel. That is, the top channel 602 may be provided into a first end section 660 and a second end section 662. In accordance with components described in the following paragraphs herein, it is possible to construct the top channel 602 merely from the end sections 660, 662, without including any type of substantially elongated intermediate section, thereby possibly saving material costs.

Turning to the drawings, and specifically FIGS. 14 and 15, the top channel 602 includes the two first and second sections 660, 662. Each section 660, 662 includes a horizontally disposed top channel web 606. Extending upwardly at a right angle from one edge 605 of the top channel web 606 is an inner top channel connecting mount 608. The inner top channel connecting mount 608 is similar in structure and function to the top mount 208 of the previously described top channel 202. The inner top channel connecting mount 608 may preferably be integral with the top channel web 606.

Extending downwardly from the outer portion of the top channel web 606 is a top door track 614, as also shown in FIG. 14. The top door track 614 is similar in structure and function to the top door track 514 previously described herein with respect to the top channel 502 and illustrated in FIG. 13. With further reference thereto, the top door track 614 includes a pair of top track flanges 616. The flanges 616 include an inner top track flange 618 and an outer top track flange 620. Each of the flanges 616 depends downwardly from the top channel web 606 and is vertically disposed when the top channel 602 is installed. The outer top track flange 620 is shown in FIG. 14 as depending downwardly directly along the edge 607 of the top channel web 606.

In addition to the top track flanges 616, the top door track 614 also includes a top channel door rail 622. The top channel door rail 622 is elongated and depends downwardly from the top channel web 606. Preferably, the top door rail 622 is spaced so as to be intermediate the pair of top track flanges 616, and equidistant from the inner top track flange 618 and the outer top track flange 620.

With the top door rails 222 and 522 previously described herein, the rails 222, 522, function with rollers, bearings or similar types of devices mounted on the screen doors themselves so as to provide for a surface for rolling motion directly on the rails 222 or 522. In this particular instance, however, the top door rail 622 is not continuous, in view of the separate sections 660 and 662. To compensate for this lack of a continuous door rail 622, the top channel 602 in accordance with the invention includes a top rail cap 670 as specifically illustrated in FIG. 15. The top rail cap 670 includes an angled pair of fins 672 at the top portion of the cap 670. The angled fins 672 form a slot 674 which extends downwardly between a pair of vertically disposed sections 676. The sections 676 are parallel to each other. At the lower portion of the sections 676 is a bulb 678 or similar type of configuration. The angled fins 672 and the vertically disposed sides or sections 676 are preferably resilient so that the top door rail 622 can be captured within the slot 674 formed within the cap 670. With this configuration, the rollers or other surfaces of a screen door 110 can slidably move along the bulb 678 formed at the bottom of the cap 670. Unlike the rail 622, the cap 670 is continuous throughout its entire length. Accordingly, the screen door 110 can essentially "ride" on the bulb 678 of the cap 670, notwithstanding the fact that the top door rail 622 is not continuous between the first section 660 and second section 662 of the top channel 602.

Figure 16:
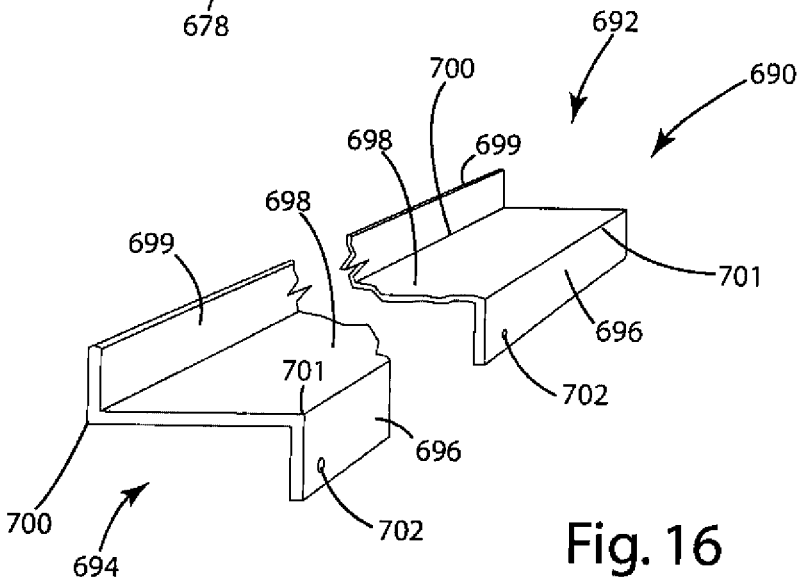
FIG. 16 is a partial, front end perspective view of a cutaway portion of a further embodiment of a bottom channel of a sliding screen door mechanism in accordance with the invention.
Figure 17:
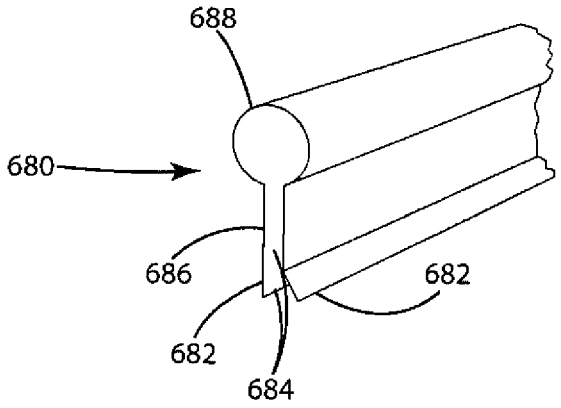
FIG. 17 is a partial, front end perspective view of a bottom channel cap which may be utilized with the bottom channel illustrated in FIG. 16.

In addition to the top channel 660 illustrated in FIGS. 14 and 15, a corresponding bottom channel 690 can also be provided. The bottom channel 690 is illustrated in FIGS. 16 and 17. As shown specifically in FIG. 16, the bottom channel 690 includes a first section 692 and a second section 694. As with the top channel 660, the bottom channel 690 is segmented into the two separate and spaced apart sections 692, 694. This separation, without any intermediate section, can be utilized in the same manner as the utilization of top channel 660 for purposes of conserving materials and material costs. Preferably, the first section 692 of the bottom channel 690 would be positioned at one end of the "run" of the screen door 110, while the second section 694 would be positioned at the opposing end.

Each of the sections 692, 694 is similar in structure and function to the bottom channel 122 previously described herein and illustrated in FIG. 3. The bottom channel 690 includes a horizontally disposed bottom channel web 698. Extending downwardly at a right angle from one edge 701 of the web 698 is a bottom channel connecting mount 696. The bottom channel connecting mount may preferably be integral with the bottom channel web 698. The bottom channel connecting mount 696 may be formed with a series of spaced apart apertures 702. The apertures 702 are utilized with connecting screws or similar connecting means (not shown) for purposes of securing the bottom channel connecting mount 696 to a generally vertical surface (not shown) which may be associated with the entry door 112. It will be apparent to those of ordinary skill in the art that numerous types of connecting means may be utilized.

Extending upwardly from an edge 700 of the bottom channel web 698 is a bottom door track 699, as also illustrated in FIG. 16. The bottom door track 699 is similar to the bottom door track 136 previously described herein with respect to the bottom channel 122 and illustrated in FIG. 3. However, because the bottom door track 699 is not continuous (in view of the separate sections 692, 694), it is not possible to have the bottom of the screen door 110 ride directly on the bottom door track 699. To overcome this discontinuity, the bottom door track 690 also includes a bottom rail cap 680, as expressly shown in FIG. 17. The bottom rail cap 680 is similar in structure and function to the top rail cap 670 previously described with respect to FIG. 15. More specifically, the bottom rail cap 680 includes a pair of angled and spaced apart fins 682 which extend downwardly from the top rail cap 670. The fins 682 form a slot 684. The sides of the slot 684 are formed by vertically disposed sections or sides 686, with the sides 686 being parallel to each other and forming the depth of the slot 684. At the top of the sides 686, a bulb 688 is formed, as again shown in FIG. 17. When installing the bottom channel 690, the bottom rail cap 680 is mounted to the upper portion of the bottom door track 699, by extending the bottom door track 699 into the resiliently formed slot 684. The slot 684 is sized and configured so as to releasably "grasp" the rail 699.

When in use, the bottom of the screen door 110 will, instead of riding directly on the bottom door track 699, ride on the bulb 688. It is apparent from the foregoing description that the bottom rail cap 680, with the bulb 688, provides for the continuous path required between the bottom channel sections 692, 694 for the bottom of the screen door 110 to conveniently roll between open and closed positions.

Figure 18:
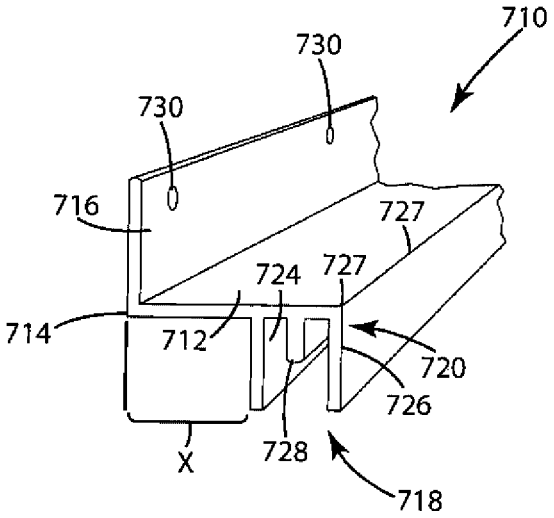
FIG. 18 is a partial, front end perspective view of a further embodiment of a top channel of a sliding screen door mechanism in accordance with the invention.

Various other embodiments of sliding screen door mechanisms may be designed without departing from the primary spirit and scope of the novel concepts of the invention. In particular, one of the advantages of screen door mechanisms in accordance with the invention relates to their capability to be sized and configured for various building structures. For example, it is possible to characterize one size of sliding screen door mechanism components (i.e., top channels, bottom channels and side channels) as being of a "standard" size. In contrast, it is also possible to develop and characterize various other sizes of the sliding screen door mechanism components as being of "custom" sizes. These concepts will be described in the following paragraphs, with reference to FIGS. 18-23. First, top channel, bottom channel and side channel components will be described which could be characterized as standard components. These components are illustrated in FIGS. 18, 20 and 22, respectively. The components are structured substantially similarly to other top channel, bottom channel and side channel components previously described herein. However, for purposes of completeness of this description, the components in these drawings will be described with different numerical references.

With reference first to FIG. 18, a top channel 710 is illustrated. The top channel 710 includes a horizontally disposed top channel web 712. Extending upwardly at a right angle from one edge 714 of the top channel web 712 is an inner top channel connecting mount 716. The inner top channel connecting mount 716 is similar in structure and function to the top mount 208 of the previously described top channel 202. The inner top channel connecting mount 716 may preferably be integral with the top channel web 712.

Extending downwardly from the outer portion of the top channel web 712 is a top channel door track 718, as also shown in FIG. 18. The top channel door track 718 is similar in structure and function to the top door track 514 previously described herein with respect to the top channel 502 and illustrated in FIG. 13. With further reference thereto, the top door track 718 includes a pair of top track flanges 720. The flanges 720 include an inner top track flange 724 and an outer top track flange 726. Each of the flanges 720 depends downwardly from the top channel web 712 and is vertically disposed when the top channel 710 is installed. The outer top track flange 726 is shown in FIG. 18 as depending downwardly directly along the edge 727 of the top channel web 712.

In addition to the top track flanges 720, the top channel door track 718 also includes a top channel door rail 728. The top channel door rail 728 is elongated and depends downwardly from the top channel web 712. Preferably, the top door rail 728 is spaced so as to be intermediate to the pair of top flanges 720, and equidistant from the inner top track flange 724 and the outer top track flange 726. In addition to the foregoing elements, the inner top channel connecting mount 716 includes spaced apart apertures 730 (two of which are illustrated in FIG. 18). The apertures 730 are adapted to receive connecting means (not shown) such as connecting screws or the like for purposes of securing the top channel 710 to a facial structure associated with the building to which the sliding screen door mechanism will be mounted.

In addition to the top channel 710 illustrated in FIG. 18, a corresponding bottom channel 732 can also be provided. The bottom channel 732 is illustrated in FIG. 20. As shown specifically therein, the bottom channel 732 includes a horizontally disposed bottom channel web 734. Extending downwardly at a right angle from one edge 736 of the web 734 is a bottom channel connecting mount 738. The bottom channel connecting mount 738 may preferably be integral with the bottom channel web 734. The bottom channel connecting mount 738 may be formed with a series of spaced apart apertures 740 (only one of which is illustrated in FIG. 20). The apertures 740 are utilized with connecting screws or similar connecting means (not shown) for purposes of securing the bottom channel connecting mount 738 to a generally vertical surface (not shown) which may be associated with the entry door 112. It will be apparent to those of ordinary skill in the art that numerous types of connecting means may be utilized.

Extending upwardly from an edge 742 of the bottom channel web 734 is a bottom channel door track 744. The bottom channel door track 744 is similar to the bottom door track 136 previously described herein with respect to the bottom channel 122 and illustrated in FIG. 3.

As with the screen door mechanisms previously described herein, the screen door mechanism illustrated in FIGS. 18 and 20 may include a side channel 746 as illustrated in FIG. 22. The side channel 746 is similar in structure and function to the side channel 360 previously described herein and illustrated in FIG. 11. More specifically, the side channel 746 may be an elongated member having a side web 748 that extends along a length of the side channel 746. A side flange 750 may extend in a perpendicular direction from the side web 748 at an edge 752 of the side web 748. As with the top channel 710 and the bottom channel 732, the side channel 746 may be constructed of any suitable structural material, and by any process suitable to the selected material. Again, an aluminum alloy extrusion may be anticipated as a common fabrication.

The side channel web 748 may include a series of apertures 754 (two of which are shown in FIG. 22) for purposes of screw mountings as previously discussed herein with respect to the top channel 710 and bottom channel 732. The side flange 750 may provide a strike or stop for a sliding screen door 110 in a closed position, and can also provide a latch mounting jamb. While the side channel 746 may extend between respective first ends of the top and bottom channel 710, 732, respectively, and a screen door jamb at the entry door 112, separate stops may be provided at respective opposite second ends of the bottom and top channels. Such stops were previously described herein and illustrated in FIGS. 3 and 4.

As also illustrated in FIG. 18, the top channel 710 may be of a certain size. For example, the portion of the width of the top channel web 712 which extends between the inner top channel connecting mount 716 and the inner top track flange 724 is illustrated as being of a dimension X. As previously referenced herein, the top channel 710 may be characterized as a "standard" top channel. In such event, the dimension X may be, for example, 1.25 inches. As with the top channel 710, the bottom channel 732 and the side channel 746 may also be characterized as "standard" sized channels.

Figure 19:
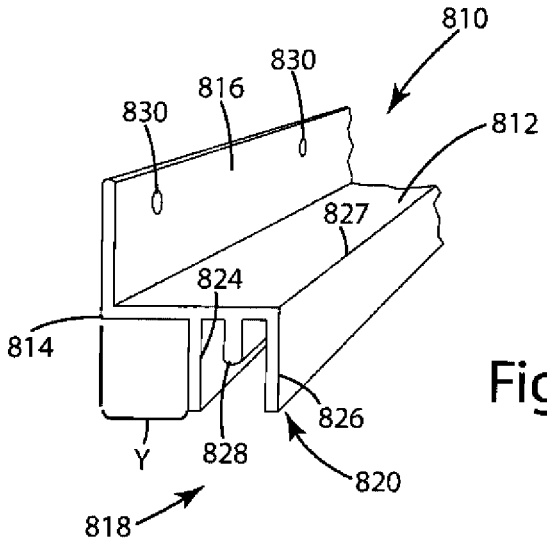
FIG. 19 is a partial, front end perspective view of another embodiment of a top channel which may be utilized in accordance with the invention, with the top channel of FIG. 19 similar to the top channel of FIG. 14, and adapted for use as a "custom" sized channel for a custom sliding screen door mechanism.
Figure 20:
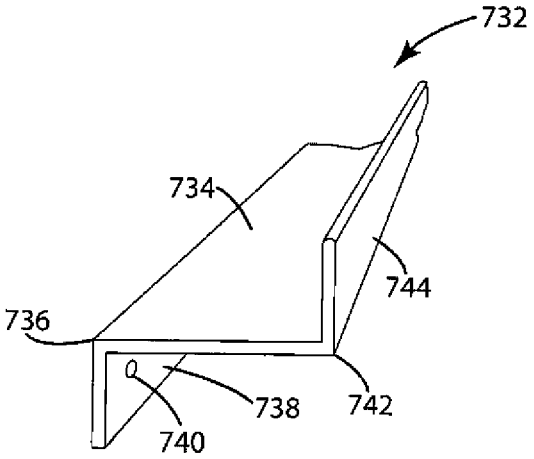
FIG. 20 is a partial, front end perspective view of another embodiment of a bottom channel of a sliding screen door mechanism in accordance with the invention.
Figure 21:
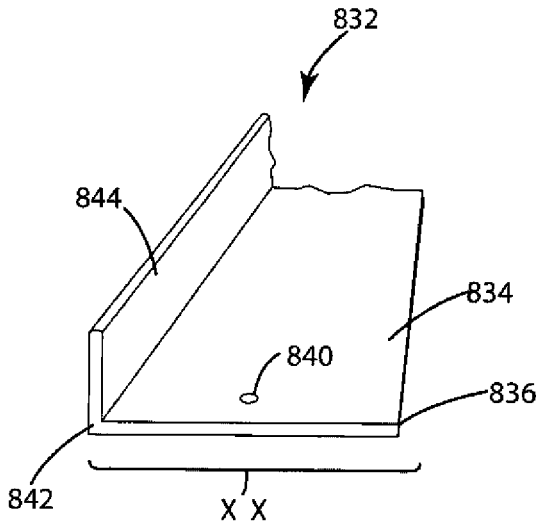
FIG. 21 is a partial, front end perspective view of an embodiment of a bottom channel of a sliding screen door mechanism in accordance with the invention, with the bottom channel shown in FIG. 21 differing from the bottom channel shown in FIG. 20, in that the bottom channel of FIG. 21 has an absence of one of the right angle flanges.
Figure 22:
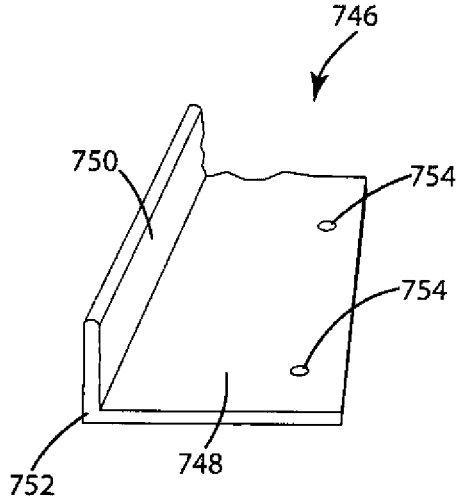
FIG. 22 is a partial, front end perspective view of a side channel of a sliding screen door mechanism in accordance with the invention.
Figure 23:
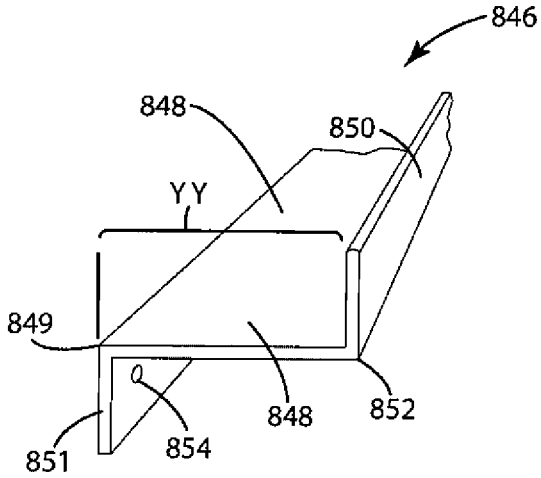
FIG. 23 is a partial, front end perspective view of another embodiment of a side channel which may be utilized with a sliding screen door mechanism in accordance with the invention, with the side channel illustrated in FIG. 23 differing from the side channel illustrated in FIG. 22, in that the side channel of FIG. 23 has part of its flat side formed in a right angle.

As earlier mentioned, the sliding screen door mechanism represented by the top channel shown in FIG. 19, the bottom channel shown in FIG. 21 and the side channel shown in FIG. 23 can be characterized as "custom" components of a screen door mechanism in accordance with the invention. The components have a substantially similar configuration to the components described in FIGS. 18, 20 and 22 representing the top channel 710, bottom channel 732 and side channel 746, respectively. Accordingly, whereas the reference numerals used with respect to FIGS. 18, 20 and 22 can be characterized as all being within the "700" series, similar numerical references will be utilized for the components shown in FIGS. 19, 21 and 23. However, the components shown in FIGS. 19, 21 and 23 will utilize an "800" series. The last two digits of each numerical reference will correspond to the last two digits of the components described in FIGS. 18, 20 and 22 which are similar in structure and function. For example, in FIG. 18, reference is made to the top channel 710. Correspondingly, in FIG. 19, reference is made to the top channel 810. More specifically, the top channel 810 includes a horizontally disposed top channel web 812. Extending upwardly at a right angle from one edge 814 of the top channel web 812 is an inner top channel connecting mount 816. The inner top channel connecting mount 816 is similar in structure and function to the top mount 716 of the previously top channel 710. The inner top channel connecting mount 816 may preferably be integral with the top channel web 812.

Extending downwardly from the outer portion of the top channel web 812 is a top channel door track 818, as also shown in FIG. 19. The top channel door track 818 is similar in structure and function to the top door track 718 previously described herein with respect to the top channel 710 and illustrated in FIG. 18. With further reference thereto, the top door track 818 includes a pair of top track flanges 820. The flanges 820 include an inner top track flange 824 and an outer top track flange 826. Each of the flanges 820 depends downwardly from the top channel web 812 and is vertically disposed when the top channel 810 is installed. The outer top track flange 826 is illustrated in FIG. 19 as depending downwardly directly along the edge 827 of the top channel web 812.

In addition to the top track flanges 820, the top channel door track 818 also includes a top channel door rail 828. The top channel door rail 828 is elongated and depends downwardly from the top channel web 812. Preferably, the top door rail 828 is spaced so as to be intermediate to the pair of top flanges 820, and equidistant from the inner top track flange 824 and the outer top track flange 826. In addition to the foregoing elements, the inner top channel connecting mount 816 includes spaced apart apertures 830 (two of which are illustrated in FIG. 19). The apertures 830 are adapted to receive connecting means (not shown) such as connecting screws or the like for the purposes of securing the top channel 810 to a facial structure associated with the building to which the sliding screen door mechanism will be mounted.

In addition to the top channel 810 illustrated in FIG. 19, a corresponding bottom channel 832 can also be provided. The bottom channel 832 is illustrated in FIG. 21. As shown specifically therein, the bottom channel 832 includes a horizontally disposed bottom channel web 834. Extending upwardly from an edge 842 of the bottom channel web 834 is a bottom channel door track 844. The bottom channel door track 844 is similar to the bottom door track 744 previously described herein with respect to the bottom channel 732 illustrated in FIG. 20.

It should be noted that the bottom channel 832 illustrated in FIG. 21 differs from the bottom channel 732 previously described herein and illustrated in FIG. 20. More specifically, the bottom channel 732 illustrated in FIG. 20 includes a bottom channel connecting mount 738 extending downwardly at a right angle from one edge 736 of the web 734. As shown in FIG. 21, there is no downwardly projecting connecting mount extending from an edge 836 of the web 834. The purpose for the omission of any type of downwardly projecting connecting mount for the bottom channel 832 is that the bottom channel 832 is adapted for use with outswinging doors. Accordingly, the bottom channel 832 is mounted to the building structure through the use of screws or other connecting means (not shown) extending through spaced apart apertures 840 (only one of which is shown in FIG. 21) extending through the web 834. The apertures 840 are thereby utilized with the connecting screws or similar connecting means for securing the web 834 to a generally horizontal surface (not shown) which may be associated with the entry door 112. It will be apparent to those of ordinary skill in the art that numerous types of connecting means may be utilized.

As with the screen door mechanisms previously described herein, the screen door mechanism illustrated in FIGS. 19 and 21 may include a side channel 846 as illustrated in FIG. 23. The side channel 846 is somewhat similar in structure and function to the side channel 746 previously described herein and illustrated in FIG. 22. More specifically, the side channel 846 may be an elongated member having a side web 848 that extends along a length of the side channel 846. A side flange 850 may extend in a perpendicular direction from the side web 848 at an edge 852 of the side web 848. As with the top channel 810 and the bottom channel 832, the side channel 846 may be constructed of any suitable structural material, and by any process suitable to the selected material. Again, an aluminum alloy extrusion may be anticipated as a common fabrication.

Although the side channel 846 is somewhat similar to the side channel 746 previously described herein, the channel differs with respect to one significant aspect. More specifically, the custom side channel 846, unlike the standard side channel 746, includes a connecting mount 851 extending at a right angle from the web 848 along the edge 849. The connecting mount 851 may include a series of apertures 854 (only one of which is illustrated in FIG. 23) for purposes of screw mountings as previously described herein with respect to the top channel 810 and the bottom channel 832. As with the custom bottom channel 832, the custom side channel 846 may preferably be utilized for outswinging doors.

The side flange 850 may provide a strike or stop for a sliding screen door 810 in a closed position, and can also provide a latch mounting jamb. While the side channel 746 may extend between first ends of the top and bottom channels 810, 832, respectively, and a screen door jamb at the entry door 112, separate stops may be provided at respective opposite second ends of the bottom and top channels. Such stops were previously described herein and illustrated in FIGS. 3 and 4.

Figure 24:
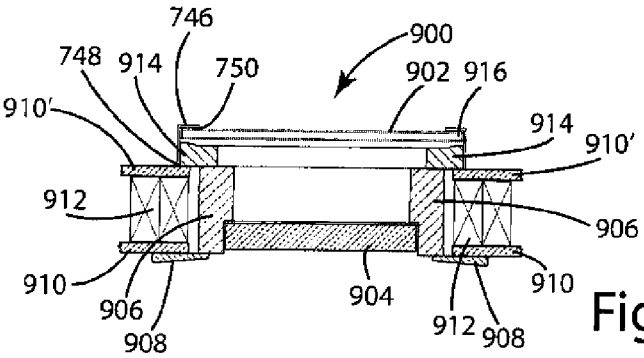
FIG. 24 is a partial top sectional view of a sliding screen door mechanism in accordance with the invention, as the mechanism may be installed with the screen door on a building structure, and with the sectional view taken between the top channel and the bottom channel.

As also illustrated in FIG. 19, the top channel 810 may be of a certain size which can be characterized as a "custom" size. For example, the portion of the width of the top channel web 812 which extends between the inner top channel connecting mount 816 and the inner top track flange 824 is illustrated as being of a dimension Y. With the top channel 810 being characterized as a "custom" top channel, the dimension Y may be, for example, 0.75 inches. Accordingly, this dimension Y is smaller than the corresponding dimension X illustrated in FIG. 18 with respect to the top channel 710. As with the top channel 810, the bottom channel 832 and the side channel 846 may also be characterized as "custom" sized channels. Still further, for the custom bottom channel 832, the width of the web 834 is illustrated as having a dimension XX. This width may, for example, be one inch. Correspondingly, and as shown in FIG. 24, the custom side channel 846 may have a web 848 with a width of dimension YY. This dimension may, for example, be 1.375 inches.

An example installation configuration of one of the sliding screen door mechanisms in accordance with the invention, and its relationship to elements of a building structure to which it is attached, is illustrated in FIGS. 24-28. In this particular instance, the example sliding screen door mechanism illustrated in FIGS. 24-28 is characterized as the previously described mechanism comprising the top channel 710, bottom channel 732 and side channel 746 illustrated in FIGS. 18, 20 and 22, respectively. However, it should be emphasized that numerous configurations of sliding screen door mechanisms in accordance with the invention may be utilized to show example installation configurations relative to a building structure. Further, FIGS. 24-28 illustrate an example building structure 900 to which the sliding screen door mechanism in accordance with the invention is attached. However, numerous configurations of building structures may be utilized with sliding screen door mechanisms in accordance with the invention, without departing from the spirit and scope of the novel concepts of the invention.

Turning to FIGS. 24-28, the example building structure 900 is illustrated. With reference first to FIG. 24, the building structure 900 is illustrated as being utilized with installation of a sliding screen door 902 which will utilize the sliding screen door mechanism in accordance with the invention. In the particular building structure 900, and as further shown in FIG. 24, the structure 900 may include a service door 904. The service door 904, which may be conventional in nature, is secured between a pair of side door jambs 906. The side door jambs 906 oppose each other as shown in FIG. 24, and extend from what can be characterized as the interior of the building structure 900 to the exterior. In the interior portion of the building structure 900, the side door jambs 906 are shown as being secured to interior trim 908.

The building structure 900 is further shown in FIG. 24 as including sections of drywall 910. In this particular configuration of a building structure 900, the drywall is shown as including sections of interior drywall 910 and exterior drywall 910'. The interior and exterior opposing sections of the drywall 910 and 910' are positioned on opposing sides of vertical supports 912, which may be in the form of 2×4 supports. Coupled to the exterior of the side door jambs 906 and exterior sections of the drywall 910' are opposing pieces of external vertical brick mold 914. A rubber seal 916 may be appropriately positioned adjacent what may be characterized as the "forward" portion of the screen door 902, and secured to the external vertical brick mold 914.

As earlier stated, FIGS. 24-28 are being used to illustrate the installation of the screen door 902 on the building structure 900, with the use of a top channel 710, bottom channel 732 and side channel 746. In FIG. 24, only the side channel 746 is shown in any particular detail. However, as illustrated therein, the side channel 746 includes the side web 748 and side flange 750.

Figure 25:
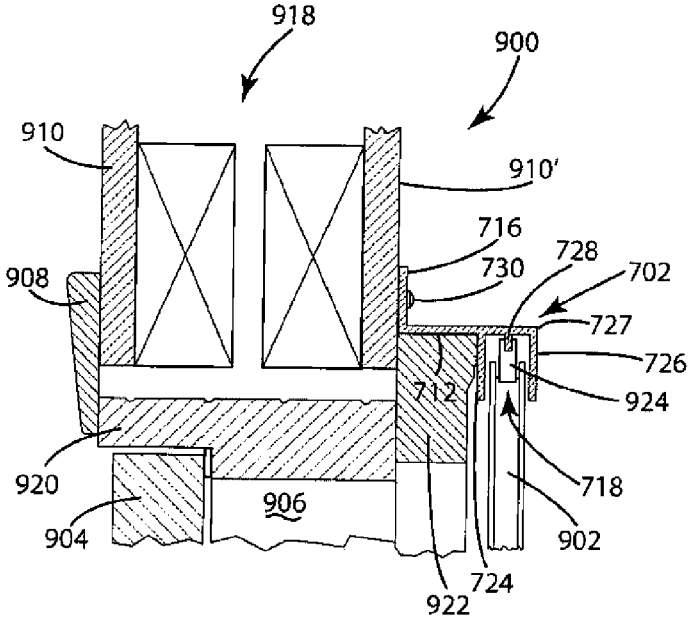
FIG. 25 is a partial upper side view of a part of the sliding screen door mechanism in accordance with the invention, as the mechanism is installed with the screen door and the building structure which is also illustrated in FIG. 24.

A further view of the building structure 900 with the installation of the screen door 902 thereon through use of the sliding screen door mechanism in accordance with the invention is illustrated in FIG. 25. As shown therein, which represents a partial upper side view of the building structure 900 and the screen door 902, the building structure 900 is again shown to include the opposing sections of drywall 910 and 910' which are positioned between supports which consist of the horizontally disposed door header 918. FIG. 25 also shows one section of the interior trim 908, a part of the service door 904 and one of the side door jambs 906. Also shown is the top door jamb 920 which is positioned above the side door jamb 906. Further, while FIG. 24 illustrates sections of external vertical brick mold 914, FIG. 25 illustrates a section of external horizontal brick mold 922.

FIG. 25 also illustrates, in a side view, the top channel 710 as it is installed on the building structure 900. Specifically, the top channel 710 is illustrated as including the horizontally disposed top channel web 712. Extending upwardly at a right angle from one edge of the top channel web 712 is an inner top channel connecting mount 716. The inner top channel connecting mount 716 is preferably integral with the top channel web 712. Extending downwardly from the outer portion of the top channel web 712 is a top channel door track 718. The top channel door track 718 includes a pair of top track flanges consisting of an inner top track flange 724 and an outer top track flange 726. Each of the flanges 724, 726 depend downwardly from the top channel web 712 and are vertically disposed as shown in FIG. 25. The outer top track flange 726 is shown as depending downwardly directly along the edge 727 of the top channel web 712.

In addition to the top track flanges 724, 726, the top channel door track 718 includes the top channel door rail 728. The top channel door rail 728 is elongated and depends downwardly from the top channel web 712. As shown further in FIG. 25, the top door rail 728 is spaced so as to be intermediate to the pair of top flanges 724, 726. The top channel 702 is secured through screws or similar connecting means extending through apertures 730 in the top channel connecting mount 716, and further extending into a section of the drywall 910. As further shown in FIG. 25, the screen door 902 includes top rollers 924 (only one of which is illustrated in FIG. 25) which will ride on the top channel door rail 728 as the screen door 902 is moved from closed to open positions.

Figure 26:
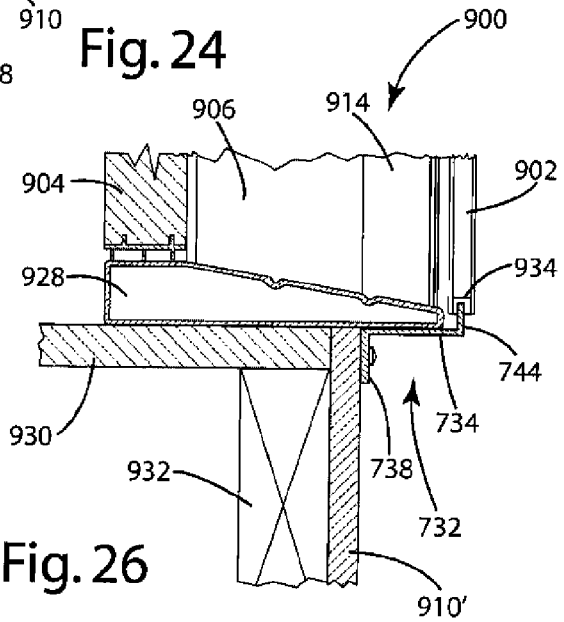
FIG. 26 is a partial lower side view of a portion of the sliding screen door mechanism in accordance with the invention, particularly showing how the bottom channel is attached to a vertical surface, with the drawing further showing a configuration such that the distance from the vertical surface to an end of the bottom channel may be approximately 1.0 inches.

FIG. 26 is a lower side view of the building structure 900, screen door 902 and the sliding screen door mechanism in accordance with the invention. In particular, FIG. 26 illustrates the bottom channel 732. More specifically, FIG. 26 illustrates a portion of the building structure 900 which includes part of the screen door 902, service door 904 and side door jamb 906. Positioned below the service door 904 and the side door jamb 906 is a door threshold 928, shown in side view in FIG. 26. The door threshold 928 rests on a floor 930 of the building structure 900. In turn, the floor 930 rests on rim joists, such as the joist 932 partially illustrated in FIG. 26. A section of drywall 910 is positioned external of the floor 930 and the illustrated rim joist 932. The bottom channel 732, also shown in side view in FIG. 26, includes the horizontally disposed bottom channel web 734. Extending downwardly at a right angle from an edge of the web 734 is a bottom channel connecting mount 738. The bottom channel connecting mount 738, as previously described herein, may be integral with the bottom channel web 734. The bottom channel connecting mount 738 may be formed with a series of spaced apart apertures utilized with connecting screws or similar connecting means for purposes of securing the connecting mount 738 to the drywall section 910. Extending upwardly from another edge of the bottom channel web 734 is the bottom channel door track 744. As previously described herein, the bottom channel door track 744 is utilized to slidably support the screen door 902 as the screen door 902 is moved between open and closed positions. More specifically, the track 744 may be utilized with a series of bottom rollers 934 so as to provide relatively smooth sliding movement of the screen door 902 on the track 744.

Figure 28:
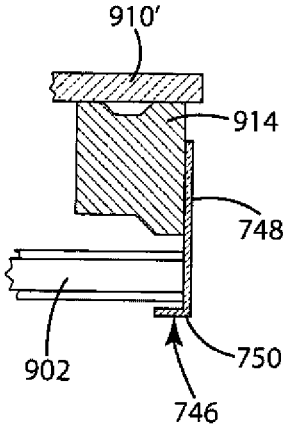
FIG. 28 is a partial top view showing, in an enlarged format, the relative configuration of the side channel and its interconnection to vertical brick mold for the sliding screen door mechanism illustrated in FIGS. 24-27 and the building structure also illustrated therein.

FIG. 27 is a partially cutaway side view of the building structure 900, screen door 902 and the components of the sliding screen door mechanism consisting of the top channel 702 and the bottom channel 732. FIG. 27 is essentially a combination of FIGS. 25 and 26 in an enlarged format. FIG. 28 is a partial top view, again in an enlarged format, showing the relative positioning of one end of the screen door 902 with the side channel 746. Also shown is the connection of the side channel 746 to the external vertical brick mold 914 which, in turn, is secured to the drywall section 910. FIG. 28 can essentially be characterized as an enlarged, top view of a section of FIG. 24. FIG. 28 expressly illustrates that when the screen door 902 is in the closed position (as shown in FIG. 28), the screen door 902 is essentially "inserted" into the side channel 746.

More specifically, FIGS. 24, 25 and 26 are included herein so as to expressly show to the reader detail relating to framing members of a standard service door. Correspondingly, FIGS. 27 and 28 are intended to illustrate to the reader the concept that effectively no alterations are required to install screen door mechanisms in accordance with the invention. Further, all channels of the screen door mechanisms in accordance with the invention will attach to the building structure and a standard service door in the same manner, although the channels (referring to the top, bottom and side channels) of the various screen door mechanisms in accordance with the invention may be of different configurations.

Various embodiments of the invention, and the principal advantages associated therewith, have been described in the foregoing paragraphs, and illustrated in the drawings. It should be understood that embodiments of the invention may be utilized with various other apparatus which can be associated with sliding screen door structures.

One will also understand that various relational terms, including left, right, front, back, top, and bottom, for example, are used in the detailed description of the invention and in the claims only to convey relative positioning of various elements of the claimed invention.

The invention claimed is:

1. In combination, a horizontally sliding screen door frame adapted to be utilized with a sliding screen door mounted thereto, and an entry door with a door threshold positioned at a bottom portion of said entry door, said sliding screen door frame at least partially circumscribing said entry door, said sliding screen door frame comprising:

a bottom channel having an elongated configuration and comprising:

bottom channel connecting means for mounting said bottom channel to a first vertical surface;

bottom channel track means adapted to cooperate with said sliding door in a sliding engagement, so as to provide a stabilized path on which said screen door may move between open and closed positions;

bottom channel web means connecting together said bottom channel connecting means and said bottom channel track means;

a top channel having an elongated configuration and comprising:

top channel connecting means for mounting said top channel to a second vertical surface;

top channel track means for receiving a top portion of said screen door in a sliding engagement, so as to provide a path for movement of said screen door between said open and said closed positions;

top channel web means connecting said top channel connecting means and said top channel track means;

a side channel extending vertically along at least a portion of a path extending between a first end of said top channel and a first end of said bottom channel, said side channel providing for a strike or stop for said screen door, when said screen door is in a closed position;

said bottom channel is sized and configured so that said bottom channel web means is positioned below a top portion of said door threshold when said frame is fully installed;

said bottom channel connecting means mounts to said first vertical surface below said top portion of said door threshold;

said bottom channel track means is positioned adjacent said door threshold and below at least a major portion of an upper surface of said door threshold;

said bottom channel connecting means is integral with said bottom channel web means, which, in turn, is integral with said bottom channel track means; and said bottom channel track means is positioned so that a user crossing said sliding screen door frame would step over said bottom channel track means, with said bottom channel track means not presenting an obstacle to said user in view of the position of said bottom channel track means adjacent to and below said at least major portion of said upper surface of said door threshold.

2. A sliding screen door frame in accordance with claim 1, characterized in that:

said bottom channel web means comprises a horizontally disposed and elongated bottom web having first and second opposing edges extending longitudinally along the elongated configuration of said bottom web; and said bottom channel connecting means comprises a vertically disposed flange connected to or integral with said first one of said opposing edges of said bottom channel web means.

3. A sliding screen door frame in accordance with claim 2, characterized in that said bottom channel track means comprises a vertically disposed and elongated flange connected to or otherwise integral with said second edge of said bottom channel web means, said flange having an upper edge operating as a bottom track for said screen door so as to provide said stabilized path.

4. A sliding screen door frame in accordance with claim 2, characterized in that said vertically disposed flange of said bottom channel connecting means comprises a bottom mount having spaced apart apertures extending horizontally therethrough, said spaced apart apertures adapted to receive attachment means for attaching said bottom mount to said stationary and vertical surface surrounding said entry door.

5. A sliding screen door frame in accordance with claim 4, characterized in that said horizontally disposed and elongated bottom web has a width between said first opposing edge and said second opposing edge which causes said bottom door track to be centered approximately 1.625 inches away from said stationary and vertical surface surrounding said entry door.

6. A sliding screen door frame in accordance with claim 5, characterized in that:

said bottom track extends upwardly approximately 1.0 inches above said horizontally disposed and elongated bottom web; and said bottom channel mount extends approximately 1.0 inches down from or below said horizontally disposed and elongated bottom web.

7. A sliding screen door frame in accordance with claim 1, characterized in that:

said top channel web means comprises a horizontally disposed and elongated top web having a first opposing edge and a second opposing edge extending longitudinally along the elongated configuration of said top web; and said top channel connecting means comprises a vertically disposed flange connected to or integral with said first opposing edge of said top web.

8. A sliding screen door frame in accordance with claim 7, characterized in that said top channel track means comprises a pair of vertically disposed and elongated flanges connected to or otherwise integral with said top web and extending downwardly from said top web at or adjacent to said second opposing edge of said top web.

9. A sliding screen door frame in accordance with claim 8, characterized in that said pair of vertically disposed and elongated flanges of said top channel track means form a downwardly opening U-shaped channel portion, said U-shaped channel portion adapted to receive said top portion of said screen door in said sliding engagement, so as to provide said path for movement of said screen door between said open and said closed positions.

10. A sliding screen door frame in accordance with claim 9, characterized in that a depth of said U-shaped channel of said top door track is sufficient so as to allow an installer to raise said screen door to a height within said U-shaped channel which permits said screen door to be set onto said bottom channel track means.

11. A sliding screen door frame in accordance with claim 9, characterized in that said vertically disposed flange of said top channel connecting means extends upwardly from said first edge of said top web, and comprises a top mount having spaced apart apertures extending horizontally therethrough, said spaced apart apertures adapted to receive attachment means for attaching said top mount to said stationary and vertical surface surrounding said entry door.

12. A sliding screen door frame in accordance with claim 11, characterized in that:

said horizontally disposed and elongated top web has a width between said first opposing edge and said second opposing edge which causes said top door track to be centered approximately 1.625 inches away from said stationary and vertical surface surrounding said entry door;

said pair of flanges of said top door track are spaced apart approximately 0.625 inches;

said pair of flanges of said top door track also extend downwardly from said top web approximately 2.0 inches.

13. A sliding screen door frame in accordance with claim 12, characterized in that said top channel mount extends approximately 1.0 inches upwardly from said first opposing edge of said horizontally disposed and elongated top web.

14. A sliding screen door frame in accordance with claim 11, characterized in that a length of said top channel track is at least twice the width of said screen door to be used with said sliding screen door frame, with said width being measured along the direction of travel of said screen door.

15. A sliding screen door frame in accordance with claim 1, characterized in that said side channel comprises:

an elongated and vertically disposed side web having first and second opposing edges; and a side flange having a vertically disposed and elongated configuration, extending along at least a portion of said first edge of said side web.

16. A sliding screen door frame in accordance with claim 15, characterized in that said flange of said side channel provides for a strike or stop for a first end of said sliding screen door, when said sliding screen door is in a closed position.

17. A sliding screen door frame in accordance with claim 15, characterized in that said side web of said side channel comprises spaced apart apertures adapted to receive attachment means for attaching said side channel to said stationary and vertical surface surrounding said entry door.

18. A sliding screen door frame in accordance with claim 17, characterized in that said side web of said side channel has a width in the range of approximately 1.0 to 1.5 inches.

19. A sliding screen door frame in accordance with claim 1, characterized in that said frame further comprises stop means mounted to respective first ends of said bottom channel and said top channel, so as to provide for a strike or stop for said sliding screen door when said screen door is in a fully open position.

20. A sliding screen door frame in accordance with claim 1, characterized in that said screen door comprises a self-closing device adapted to move said screen door to a fully closed position following the application of external forces on said screen door which cause said screen door to move to a fully open or partially open position.

* * * * *